US006945819B2

(12) United States Patent
Laub et al.

(10) Patent No.: US 6,945,819 B2
(45) Date of Patent: Sep. 20, 2005

(54) COAXIAL CABLE DISPLACEMENT CONTACT

(75) Inventors: Michael F. Laub, Harrisburg, PA (US); Richard J. Perko, Harrisburg, PA (US); John P. Huss, Jr., Harrisburg, PA (US); Charles R. Malstrom, Lebanon, PA (US)

(73) Assignee: Tyco Electronics Corporation, Middletown, PA (US)

( * ) Notice: Subject to any disclaimer, the term of this patent is extended or adjusted under 35 U.S.C. 154(b) by 112 days.

(21) Appl. No.: 10/783,937

(22) Filed: Feb. 20, 2004

(65) Prior Publication Data

US 2004/0166731 A1 Aug. 26, 2004

Related U.S. Application Data

(62) Division of application No. 10/004,979, filed on Dec. 5, 2001, now Pat. No. 6,746,268.

(51) Int. Cl.[7] ..... H01R 9/05
(52) U.S. Cl. ..... 439/585; 439/394; 29/863
(58) Field of Search ..... 29/863, 857, 862, 29/751, 753, 758, 828; 439/394–396, 406–407, 578

(56) References Cited

U.S. PATENT DOCUMENTS 5,469,613 A * 11/1995 McMills et al. ..... 29/751
5,490,803 A * 2/1996 McMills et al. ..... 439/276
5,997,335 A * 12/1999 Kameyama et al. ..... 439/394
6,101,712 A * 8/2000 Wright ..... 29/863

* cited by examiner

*Primary Examiner*—J. F. Duverne

(57) ABSTRACT

A coaxial cable connector is provided for interconnecting coaxial cables having center and outer conductors. The coaxial cable connector includes inner and outer contracts configured to be securable to inner and outer conductors of coaxial cables. A connector housing has a cavity for receiving the inner contact. The outer contacts are secured to the connector housing. A coaxial cable displacement contact section connected to the outer contacts has at least one displacement beam and braid-receiving slot dimensioned to pierce the coaxial cable automatically when the outer conductors are mounted to the coaxial cable connector. The coaxial cable displacement contact section affords an automated and reliable technique for interconnecting contacts and outer coaxial cable conductors.

4 Claims, 14 Drawing Sheets

COAXIAL CABLE DISPLACEMENT CONTACT

RELATED APPLICATIONS

The present application is a divisional application of U.S. patent application Ser. No. 10/004,979 filed Dec. 5, 2001 now U.S. Pat. No. 6,746,268 and relates to co-pending U.S. patent application Ser. No. 10/005,625 filed on Dec. 5, 2001 and entitled "Coaxial Cable Connector". The co-pending application names Michael F. Laub; Richard J. Perko; Sean P. McCarthy; and Jerry H. Bogar as joint inventors and is assigned to the same assignee as the present application and is incorporated by reference herein in its entirety including the specification, drawings, claims, abstract and the like.

BACKGROUND OF THE INVENTION

Certain embodiments of the present invention generally relate to a coaxial cable displacement contact having a displacement beam configuration that facilitates manual and automated assembly of a connector and a coaxial cable. Other embodiments of the present invention generally relate to methods of manufacture for coaxial cable displacement contacts and their assembly with a coaxial cable.

In the past, connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires), and the cable braid is surrounded by a cable jacket. In most coaxial cable applications, it is preferable to match the impedance between source and destination electrical components located at opposite ends of the coaxial cable. Consequently, when sections of coaxial cable are interconnected, it is preferable that the impedance remain matched through the interconnection.

Conventional coaxial connectors are formed from generally circular components partly to conform to the circular geometry of the coaxial cable. Circular components are typically manufactured using screw machining and diecast processes that may be difficult to implement. As the difficulty of the manufacturing process increases, the cost to manufacture each individual component similarly increases. Accordingly, conventional coaxial connectors have proven to be somewhat expensive to manufacture. Many of the circular geometries for coaxial connectors were developed based on interface standards derived from military requirements. These more costly manufacturing processes for the circular geometries were satisfactory for low volume, high priced applications, as in military systems and the like.

Today, however, coaxial cables are becoming more widely used. The wider applicability of coaxial cables demands a high-volume, low-cost manufacturing process for coaxial cable connectors. Recently, demand has arisen for radio frequency (RF) coaxial cables in applications such as the automotive industry. The demand for RF coaxial cables in the automotive industry is due in part to the increased electrical content within automobiles, such as AM/FM radios, cellular phones, GPS, satellite radios, Blue Tooth™ compatibility systems and the like. Also, conventional techniques for assembling coaxial cables and connectors are not suitable for automation, and thus are time consuming and expensive. Conventional assembly techniques involve the following general procedure:

a) after sliding a ferrule over the cable, stripping the jacket to expose the outer conductive braid, b) folding the outer conductive braid back over the ferrule to expose a portion of the dielectric layer, c) stripping the exposed portion of the dielectric layer to expose a portion of the inner conductor, d) connecting a contact to the inner conductor, and e) connecting a contact to the outer conductive braid.

The above-noted procedure for assembling a connector and a coaxial cable is not easily automated and requires several manual steps that render the procedure time consuming and expensive.

Today's increased demand for coaxial cables has caused a need to improve the design for coaxial connectors and the methods of manufacture and assembly thereof.

BRIEF SUMMARY OF THE INVENTION

In accordance with one aspect of the present invention, a connector is provided with a coaxial cable displacement contact connectable to at least one outer conductor, for example a conductive braid. The coaxial cable displacement contact includes a displacement beam insertable into the coaxial cable. The displacement beam and an associated wall define a braid-receiving slot spaced to receive the outer conductive braid of the coaxial cable when the displacement beam is inserted into the coaxial cable. Optionally, the connector may include a pair of coaxial cable displacement contacts with respective displacement beams spaced apart by a distance greater than a diameter of the inner conductor of the coaxial cable such that both of the displacement beams pierce the outer conductive braid of the coaxial cable.

In accordance with another aspect of the present invention, a method is provided for mounting a connector to a coaxial cable having inner and outer conductors separated by a dielectric layer. The method includes exposing an end portion of an inner conductor of the coaxial cable and securing an inner contact to the end portion of the inner conductor. The coaxial cable and inner contact are positioned in an insulated housing with the inner and outer conductors of the coaxial cable extending along a longitudinal axis of the insulated housing. An outer contact is laterally inserted onto the coaxial cable in a direction transverse to the longitudinal axis until the outer contact pierces the coaxial cable, exerts a retention force on the outer conductor, and makes electrical connection therewith.

Optionally, each of a pair of outer contacts may laterally pierce an associated coaxial cable. When inserting the outer contacts, each coaxial cable is centered over a gap between a pair of displacement beams provided in an associated outer contact. The method then includes piercing the coaxial cable with the displacement beams until the displacement beams electrically engage and exert a retention force upon the outer conductor (e.g., a friction force of desired magnitude sufficient to hold the outer contact on the coaxial cable under certain conditions). Optionally, the method includes laterally inserting an inner contact into a slot in a side of the insulated housing along a direction transverse to the longitudinal axis of the insulated housing. Optionally, the method includes orienting the inner and outer contacts in parallel planes extending parallel to the longitudinal axis.

In accordance with another aspect of the present invention, a coaxial cable displacement contact is provided for connection with a coaxial cable having an inner conductor and an outer conductor separated by a dielectric layer and encased in a jacket. The coaxial cable displacement contact comprises a forked section having a displacement beam and contact wall separated by a braid-receiving slot. The braid-receiving slot has a slot width corresponding to a radial width of an outer conductor of a coaxial cable. The displacement beam is positioned to displace a portion of a dielectric layer and a jacket during insertion. The displacement beam is configured to induce lateral retention forces on a section of an outer conductor of a coaxial cable wedged in the braid-receiving slot.

Optionally, two coaxial cable displacement contacts comprising two respective displacement beams may be provided which are separated by a cable channel configured to receive an inner conductor and a portion of a dielectric layer surrounding an inner conductor of a coaxial cable. The cable channel has a width less than an inner diameter of an outer conductor of the coaxial cable.

In accordance with another aspect of the present invention, a strain relief is provided for a coaxial cable connector. The strain relief includes a strain relief crimp and a strain relief member. The strain relief crimp includes a body portion with arms secured to opposite ends thereof and with a cable grip formed in the center of the body portion. The cable grip is configured to pierce a jacket of a coaxial cable and engage an outer conductor thereof. The arms include ribs along opposite sides thereof. The strain relief member includes a base configured to receive a coaxial cable and having channels extending through the base along opposite ends thereof. The channels are dimensioned and aligned to frictionally receive and retain the arms. The cable grip pierces the jacket of the coaxial cable and engages the outer conductor to resist movement between the coaxial cable and the strain relief crimp when the strain relief crimp and strain relief member are joined. The cable grip affords secure engagement between the strain relief and the coaxial cable without the need for the strain relief to apply lateral forces to the coaxial cables so strong as to deform the circular geometry of the coaxial cable which may otherwise impair the signal performance and impedance thereof.

Optionally, the coaxial cable displacement contact may further include a cable retention housing having a channel with a radiused inner surface conforming to a shape of, and configured to receive, a coaxial cable. The cable retention housing has a guideway for slidably receiving the coaxial cable displacement contact in an orientation transverse to an axis of the channel. The housing includes a channel with an inner contour conforming to a shape of a coaxial cable to prevent deformation of the coaxial cable when the displacement beam pierces the jacket and outer conductor of a coaxial cable. Optionally, the coaxial cable displacement contact may be provided with a cable support configured to orient a coaxial cable along a predefined cable axis. The cable support includes opposed contact guides oriented in a plane transverse to the predefined cable axis. The contact guides slidably receive and align opposite ends of the coaxial cable displacement contact to guide the displacement beam onto the outer conductor of a coaxial cable.

Figure 1:
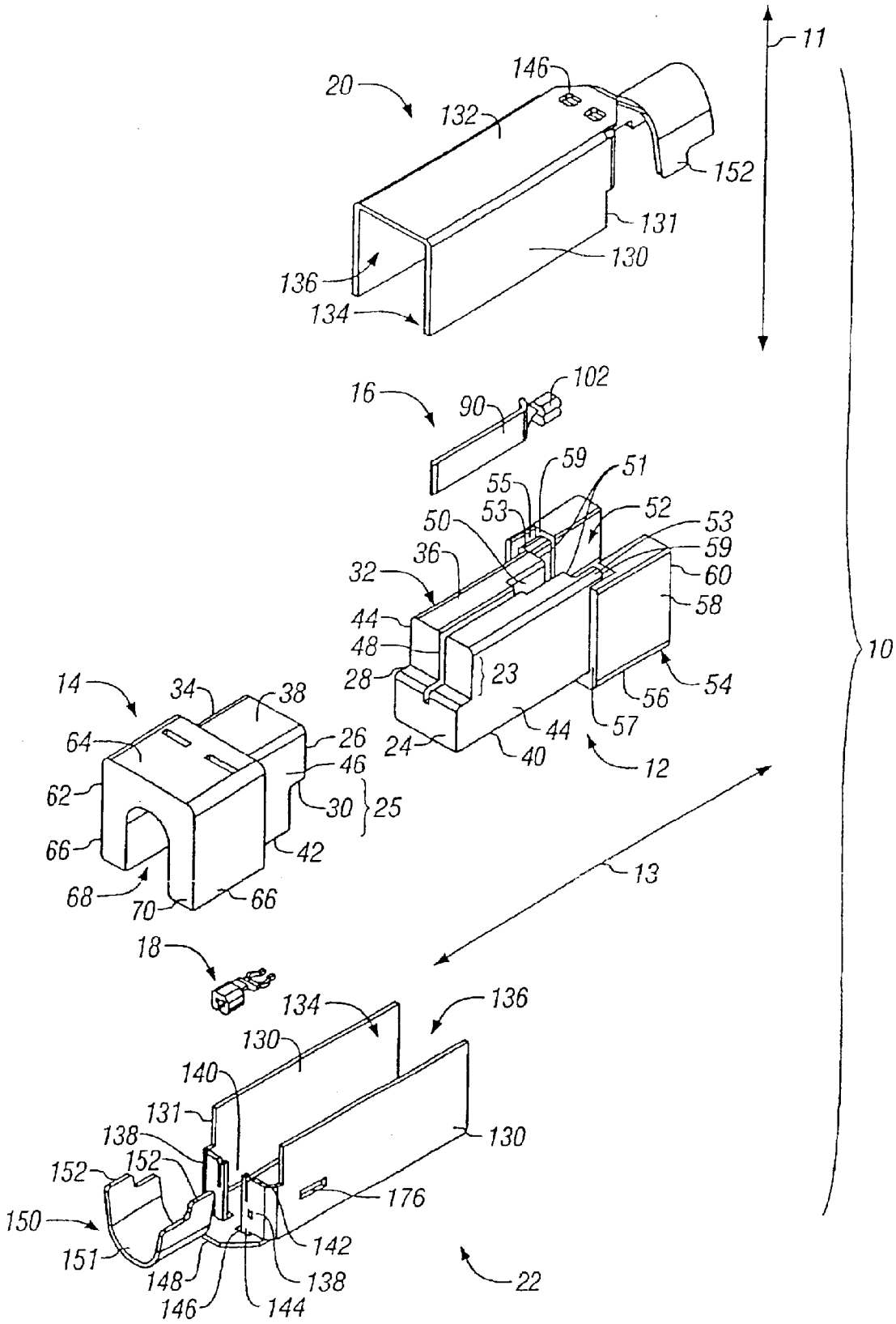
FIG. 1 illustrates an exploded isometric view of a connector formed in accordance with at least one embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

Figure 2:
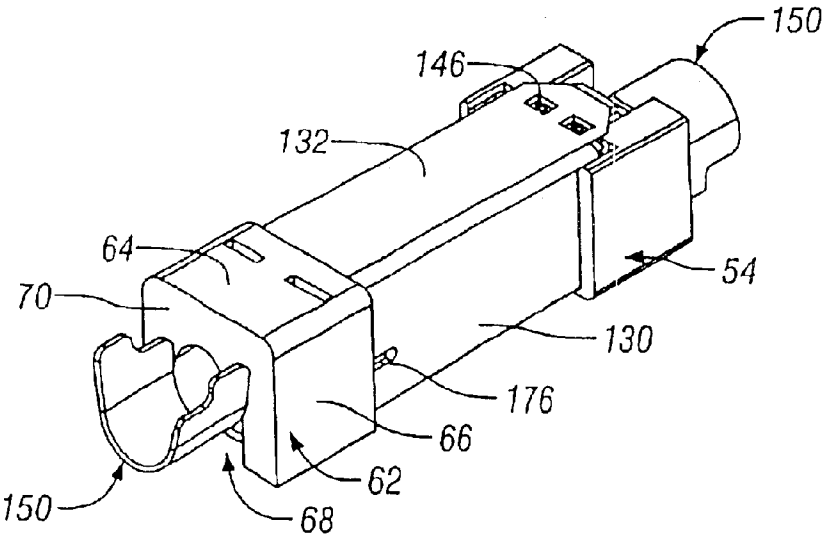
FIG. 2 illustrates an isometric view of an assembled connector formed in accordance with at least one embodiment of the present invention.

FIG. 1 illustrates a coaxial cable connector 10 formed in accordance with an embodiment of the present invention. The coaxial cable connector 10 includes insulated housings 12 and 14 that are matable with one another when the coaxial cable connector 10 is fully assembled. Optionally, the insulated housings 12 and 14 may be assembled from more than two pieces, or formed together as one unitary structure. The coaxial cable connector 10 further includes a blade contact 16 and a receptacle contact 18 that are separately securable to center conductors of coaxial cables (not shown in FIG. 1) and engage one another both frictionally and electrically when the coaxial cable connector 10 is fully assembled to form an electrical path between the center conductors. Optionally, only one of the blade contact 16 and the receptacle contact 18 may be securable to a coaxial cable. In this alternative embodiment, the other of the blade contact 16 and the receptacle contact 18 may be connected to a circuit board, an electrical component, a non-coaxial cable and the like. First and second contact shells 20 and 22, when electrically joined, form a shielded chamber extending along a longitudinal axis of the contact shells 20 and 22. The contact shells 20 and 22 substantially surround a perimeter of the insulated housings 12 and 14. The contact shells 20 and 22 are configured to electrically engage outer conductors of the coaxial cable to form an electrical path there between. FIG. 2 illustrates the coaxial cable connector 10 fully assembled, but without the coaxial cables.

The insulated housings 12 and 14 include mating faces 24 and 26, respectively, that abut against one another when the coaxial cable connector 10 is fully assembled. In the embodiment of FIG. 1, the mating faces 24 and 26 are formed with notched portions 23 and 25 defining shelves 28 and 30, respectively, that join one another to ensure proper vertical alignment between the insulated housings 12 and 14. The insulated housings 12 and 14 include rectangular body sections 32 and 34, respectively, defined by top walls 36 and 38, bottom walls 40 and 42, and side walls 44 and 46, respectively. The body sections 32 and 34 are surrounded by the contact shells 20 and 22. The insulated housings 12 and 14 are formed of a dielectric material of a predetermined thickness to afford a desired impedance through the coaxial cable connector 10.

The insulated housing 12 includes a slot 48 extending from the mating face 24 rearward along a length of the body section 32. The slot 48 has an upper edge opening onto the top wall 36. The slot 48 includes a rear section that flares into a chamber 50 having an upper edge that also opens onto the top wall 36. The chamber 50 opens into an even wider cavity 52 at a rear end 53 of the body section 32. The body section 32 is formed integrally with a shroud 54 that is shaped in a rectangular U-shape with bottom and side walls 56 and 58, respectively. The bottom and side walls 56 and 58 cooperate to define a portion of the cavity 52.

The body section 32 and shroud 54 join at an interface that is shaped to accept corresponding features on the contact shell 20 (discussed below in more detail). At the interface, vertical channels 55 are provided between interior surfaces of the leading edges 57 of the side walls 58 and exterior surfaces of the rear ends 53 of the side walls 44. The channels 55 receive end portions of the contact shell 20.

Upper portions of the channels 55 communicate with transverse arm relief slots 59 that are directed toward one another. The arm relief slots 59 are positioned between the rear ends 53 of side walls 44 and the main body portion of the side walls 58 of the shroud 54. The arm relief slots 59 receive coaxial cable displacement members, such as coaxial cable displacement contacts 138 on the contact shells 20 and 22 to permit the coaxial cable displacement contacts 138 to be inserted and pierce the coaxial cable.

The blade contact 16 is mounted on an end of the coaxial cable. The cavity 52, chamber 50, and slot 48 collectively receive the end of the coaxial cable and the blade contact 16. The cavity 52, chamber 50, and slot 48 have open upper edges to facilitate automated assembly of the coaxial cable connector 10 by permitting the coaxial cable and blade contact 16 mounted thereto to be easily and automatically inserted downward in a transverse direction into the insulated housing 12. Optionally, the coaxial cable and blade contact 16 may be inserted into the insulated housing 12 through the rear end 60.

Figure 3:
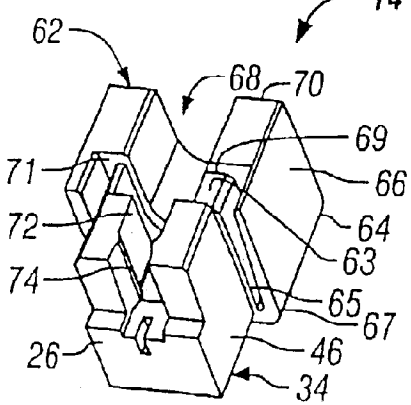
FIG. 3 illustrates an isometric view of an insulated housing formed in accordance with at least one embodiment of the present invention.

FIG. 3 illustrates the insulated housing 14 in more detail. The insulated housing 14 also includes a shroud 62 formed on the rear end of the body section 34. The shroud 62 includes top and side walls 64 and 66, respectively, that cooperate to define a U-shaped channel or cavity 68 opening to the rear end 70 of the insulated housing 14. The cavity 68 receives a coaxial cable with the receptacle contact 18 mounted thereon. The body section 34 includes a chamber 72 having a front end 74 opening onto the mating face 26. The front end 74 includes beveled edges. The rear end of the chamber 72 communicates with the cavity 68 defined by the shroud 62 and a rear end 63 of the body section 34.

The insulated housing 14 also includes vertical channels 65 extending along a rear end 63 of the body section 34 between exterior surfaces of the side walls 46 and interior surfaces of the leading edges 67 of the side walls 66. The channels 65 are sufficient in depth to receive end portions of the contact shell 22. The channels 65 communicate with transverse arm relief slots 69 directed toward one another. The arm relief slots 69 are located between rear ends 63 of the side walls 46 and shelves 71 on the side walls 66. The arm relief slots 69 define guideways that receive coaxial cable displacement contacts 138 on the contact shell 22.

Figure 4:
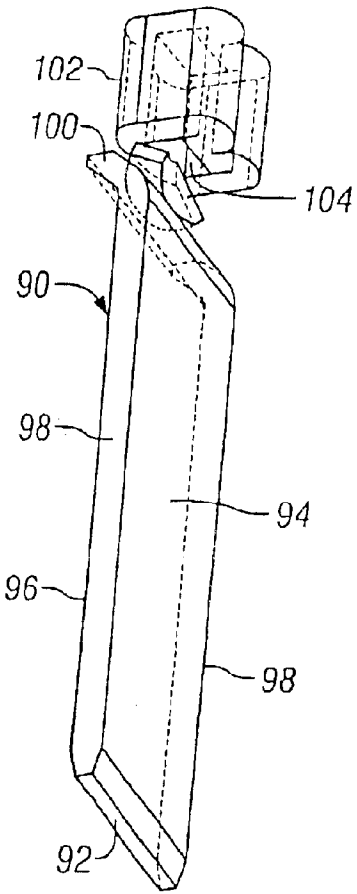
FIG. 4 illustrates an isometric view of a contact blade formed in accordance with at least one embodiment of the present invention.

FIG. 4 illustrates a blade contact 16 in more detail. The blade contact 16 includes a flat planar body section 90 having a lead edge 92 that is beveled. The body section 90 includes upper and lower sides 94 and 96 aligned substantially parallel to one another and parallel to a plane of the blade contact. Side edges 98 extend along a length of the body section 90. A rear end 100 of the body section 90 is formed with a wire crimp 102 having an opening 104 therethrough. The opening 104 receives the center conductor(s) of the coaxial cable. The wire crimp 102 may be compressed to securely, frictionally engage the center conductor(s) of the coaxial cable to mount the blade contact 16 on an end of the coaxial cable.

Figure 5:
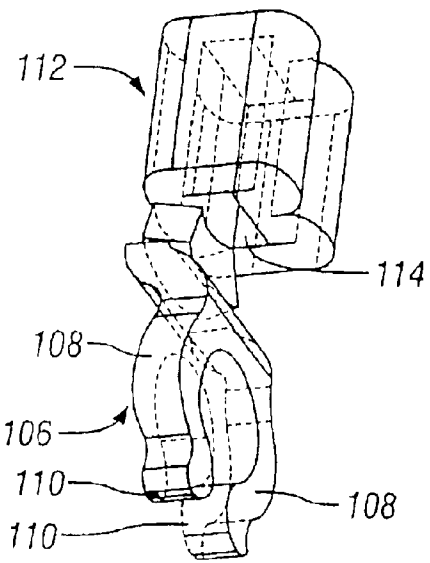
FIG. 5 illustrates an isometric view of a receptacle contact formed in accordance with at least one embodiment of the present invention.

FIG. 5 illustrates the receptacle contact 18 in more detail. The receptacle contact 18 includes a forked body section 106 having a pair of fingers 108 formed in a C-shape. Outer tips of the fingers 108 have contact surfaces 110 spaced apart from one another a distance that is slightly less than a width of the body section 90 of the blade contact 16. The contact surfaces 110 electrically engage the upper and lower sides 94 and 96 of the blade contact 16 when connected thereto. A rear end of the forked body section 106 is formed with a wire crimp 112 having an opening 114 therethrough. The opening 114 receives the center conductor(s) of a coaxial cable. The center conductors may be securely fixed to the receptacle contact 18 by compressing the wire crimp 112.

Figure 6:
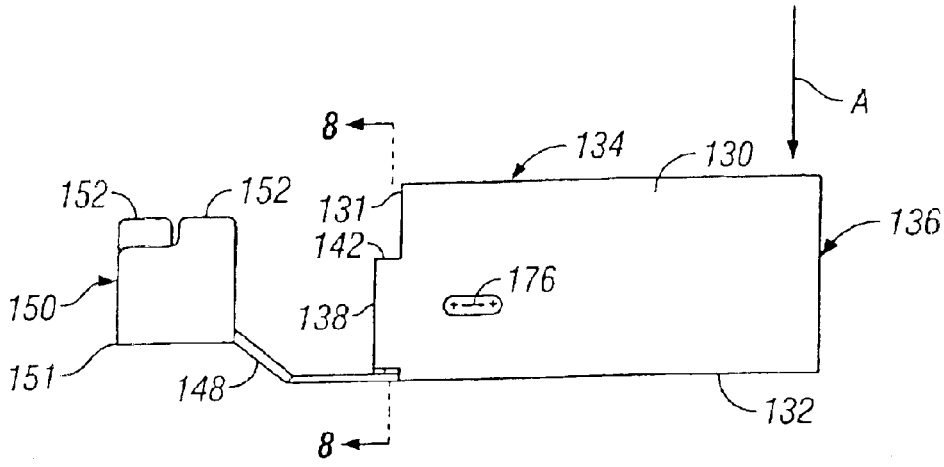
FIG. 6 illustrates a side view of a contact shell formed in accordance with at least one embodiment of the present invention.
Figure 7:
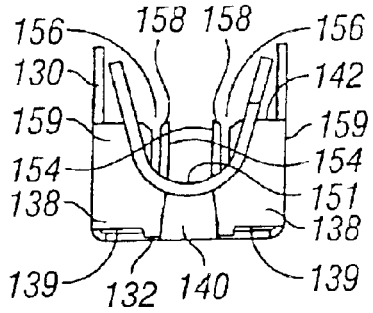
FIG. 7 illustrates an end view of a contact shell formed in accordance with at least one embodiment of the present invention.
Figure 8:
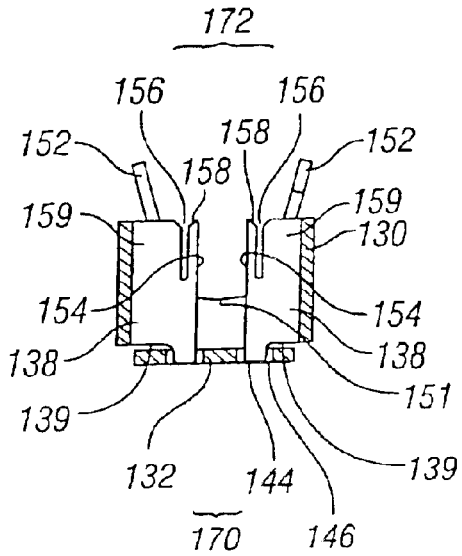
FIG. 8 illustrates a sectional view of a contact shell taken along line 8—8 in FIG. 6 in accordance with at least one embodiment of the present invention.

FIGS. 6–8 illustrate the contact shells 20.and 22 in more detail. The contact shells 20 and 22 are similarly constructed; thus, the following discussion is only in connection with the contact shell 20. The contact shells 20 and 22 may be stamped and formed from sheets of conductive material into a U-shape. The contact shell 20 includes side walls 130 formed parallel to one another and extending along planes parallel to a longitudinal axis of the contact shell 20. A connecting wall 132 interconnects the side walls 130. The connecting wall 132 is also planar in design and aligned in a plane extending parallel to the longitudinal axis of the contact shell 20, but transverse to the planes containing the side walls 130. An open face 134 (better shown in FIG. 1) extends along the side walls 130 opposite the connecting wall 132. An open end 136 is provided at one end and a cable retention end 131 is provided at an opposite end of the side and connecting walls 130 and 132.

The open face 134 of the contact shell 20 extends along the entire length of the side walls 130 from the cable retention end 131 to the open end 136 to facilitate manufacturability of the contact shell and assembly of the connector. More specifically, the contact shell 20 is easily manufactured, such as by stamping the side and connecting walls 130 and 132 from a common piece of material and then forming/bending the side walls 130 at a right angle to the connecting wall 132. By leaving the open face 134, the stamping or forming operations are simplified. During assembly, the open face 134 on each contact shell 20 and 22 permits the coaxial cables, as well as the corresponding blade and receptacle contacts 16 and 18, to be side loaded. Side loading involves inserting the coaxial cable and corresponding blade or receptacle contact 16 or 18 along a path denoted by arrow A in FIG. 6 in a direction transverse to a longitudinal axis of the contact shell 20.

The U-shaped configuration formed by the side and connecting walls 130 and 132 enables the contact shells 20 and 22 to be joined in a manner that provides 360 degrees of shielding around the perimeter of the blade and receptacle contacts 16 and 18. When joined, the contact shells 20 and 22 also provide 360 degrees of shielding in a plane transverse to a longitudinal axis of the coaxial cable. The 360 degrees of shielding substantially surrounds the portions of the inner conductors of the coaxial cables that are not covered by the outer conductors of the coaxial cables. When the contact shells 20 and 22 are joined, the connecting wall 132 of contact shell 20 covers the open face 134 of contact shell 22. Similarly, the connecting wall 132 of contact shell 22 covers the open face 134 of contact shell 20. The side walls 130 of opposite contact shells 20 and 22 overlap one another.

The coaxial cable displacement contacts 138 are formed on the cable retention ends 131 of the side walls 130. The coaxial cable displacement contacts 138 are bent inward to face one another. Each pair of coaxial cable displacement contacts 138 lie in a plane perpendicular to the longitudinal axis of the contact shells 20 and 22. The plane containing the pair of coaxial cable displacement contacts 138 joins the corresponding cable retention end 131. The coaxial cable displacement contacts 138 are spaced apart by a gap 140. The gap 140 between the inner edges of the coaxial cable displacement contacts 138 is provided with a width based on the dimensions of the coaxial cable to be joined with the contact shell 20. The coaxial cable displacement contacts 138 are shorter in height than the side walls 130 to form a shelf 142 that is slidable along rear ends of the side walls 44 of the insulated housing 12. Optionally, the coaxial cable displacement members, such as coaxial cable displacement contacts 138 may be formed separate from, or stamped integral with, any other portion of the contact shell 20, 22 proximate thereto.

The coaxial cable displacement contacts 138 include bases 139 having support projections 144 that are loosely received in holes 146 formed in the front section of the connecting wall 132. An assembly tool (not shown) presses against the support projections 144 to mount the coaxial cable displacement contacts 138 onto the cable. Each coaxial cable displacement contact 138 includes a forked section that extends upward from the base 139.

The side and connecting walls 130 and 132 extend up to the plane in which the coaxial cable displacement contacts 138 engage the coaxial cable. Hence, the entire length of the coaxial cables outside of the contact shells 20 and 22 shields the inner conductor with outer conductor. The portion of the coaxial cable outside, but leading up to the contact shell is self shielded. The only portion of the inner conductor exposed (e.g., not covered by the outer conductor) is inside the shielded chamber formed by mating contact shells 20 and 22. The shelves 142 (FIG. 9) join the braid receiving slots 156 at a beveled edge that serves as a lead-in portion to direct the cable onto the displacement beams 154. The shelves 142 and coaxial cable displacement contacts 138 are received in the transverse arm relief slots 59 and 69 in respective insulated housings 12 and 14. The displacement beams 154 and the walls 159 induce lateral retention forces on a section of an outer conductor wedged in the braid-receiving slots 156. The cavity 68 in the shroud 62 and the vertical channels 65 are spaced relative to each other to center the coaxial cable (not shown) between the coaxial cable displacement contacts 138, thereby properly aligning the displacement beams 154 with respect to the outer conductor of the coaxial cable.

The connecting wall 132 includes a lip section 148 extending forward of the holes 146. The lip section 148 is tapered inward toward its center and formed with a wire crimp 150 on a distal end thereof. The wire crimp 150 includes step-shaped tips 152 that join one another when folded inward to be clamped onto a coaxial cable. The wire crimp 150 also serves as a strain relief to prevent motion between the coaxial cable and the coaxial cable displacement contacts 138.

As shown in FIGS. 7 and 8, the coaxial cable displacement contacts 138 include, proximate inner edges thereof, displacement beams 154 separated from the wall 159 of the coaxial cable displacement contacts 138 by braid-receiving slots 156. Beam tips 158 of the displacement beams 154 are tapered to facilitate insertion into the coaxial cable when the contact shells 20 and 22 are mounted on the coaxial cables.

Figure 9:
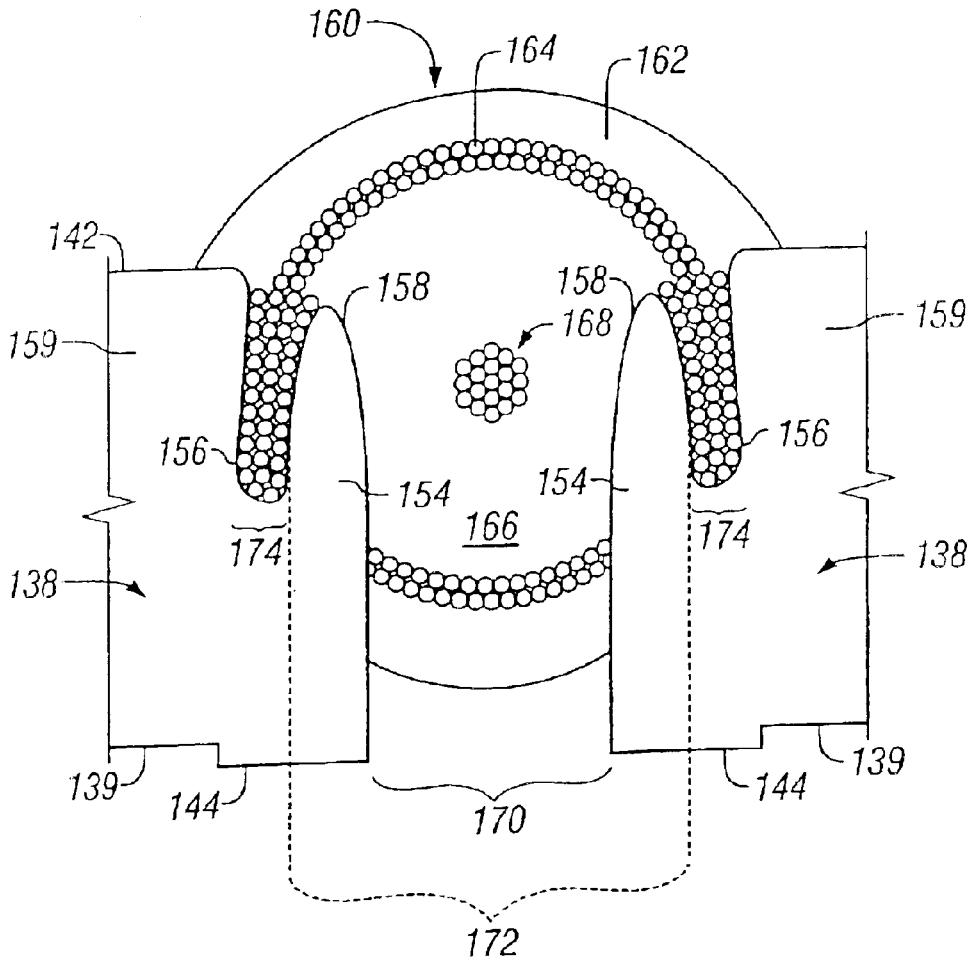
FIG. 9 illustrates a coaxial cable displacement contact mounted to a coaxial cable in accordance with at least one embodiment of the present invention.

FIG. 9 illustrates the operation of the coaxial cable displacement contacts 138 when assembled to a coaxial cable 160. This embodiment includes a pair of coaxial cable displacement contacts 138. When the contact shells 20 and 22 are mounted to the coaxial cables 160, the beam tips 158 pierce the cable jacket 162 and outer cable braid 164 and extend into the cable dielectric 166. The braid-receiving slots 156 securely receive and engage the outer cable braid 164, through a retention or normal force, to form an electrical connection between the contact shells 20 and 22 and the outer conductors (namely the outer cable braids 164) of the coaxial cable 160. The retention or normal force constitutes a friction force of a magnitude sufficient to provide a long term reliable contact interface.

The displacement beams 154 are spaced apart by a beam-to-beam distance 170 that is greater than the outer diameter of the center conductor 168, but less than the inner diameter of the outer cable braid 164 to ensure that the displacement beams 154 do not electrically contact the center conductor 168, but do pierce the outer cable braids 164. The displacement beams 154 are formed with a predefined outer beam width 172 and the braid-receiving slots 156 are formed with a predefined slot width 174 based on the inner and outer diameters of the outer cable braid 164 to ensure that the displacement beams 154 pierce the outer cable braid 164, while the braid-receiving slots 156 have a width sufficient to firmly receive the outer cable braid 164 and form a reliable electrical connection therewith. The cable braid 164 has a radial width defined by the difference between inner and outer diameters of the cable braid 164, or in other words, a width of the cable braid 164 that is measured in a direction parallel to the radius of the cable braid 164.

As illustrated in FIG. 6, at least one side wall 130 may include a protrusion 176 therein to frictionally mate with the interior of the side wall 130 of the opposite contact shell 20 and 22 to ensure adequate normal force between the contacts shells 20 and 22 to ensure a reliable electrical interface.

Optionally, both coaxial cable displacement contacts 138 may be formed integrally with one another and attached (integrally or otherwise) to only one of the side walls 130 and/or connecting wall 132. When formed integrally with one another, the coaxial cable displacement contacts 138 would still include a partial notch (resembling the upper end of gap 140) between the upper ends of the displacement beams 154 to form an area to accept the portion of the coaxial cable that is not pierced by the displacement beams 154. Hence, the gap 140 need not extend along the entire length of the displacement beams 154, but instead may only be provided near the upper ends thereof.

Figure 10A:
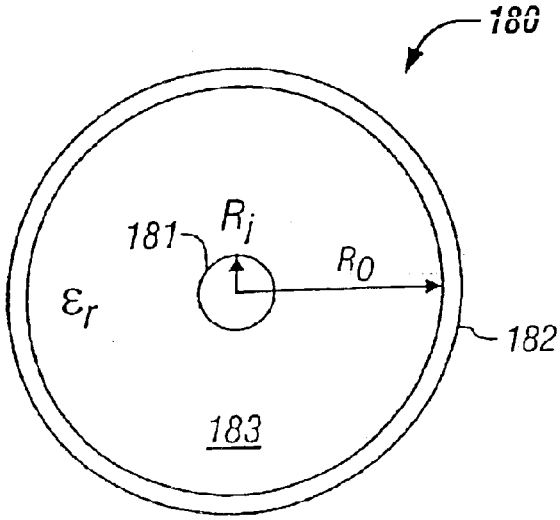
FIG. 10*a* illustrates a coaxial cable geometry for a coaxial cable suited for connection to a connector formed in accordance with at least one embodiment of the present invention.

FIG. 10*a* illustrates a graphical representation of a coaxial cable geometry 180 including a center conductor 181. The center conductor 181 is centered within an intermediate dielectric material 183 that is surrounded by a cylindrical outer conductor 182, thereby centering the inner conductor 181 in the outer conductor 182. The outer conductor 182 may be formed as a braid type conductor and the like. The center conductor 181 has a radius $r_i$, while the outer conductor 182 has an inner radius $r_O$. The dielectric material 183 has a relative dielectric constant of $\epsilon_r$. The general formula defining the impedance produced by the coaxial cable geometry 180 is represented by the following equation:

$$Z_O = \frac{60}{\sqrt{\varepsilon_r}} \ln\left(\frac{r_o}{r_i}\right) \text{ Ohms} \qquad \text{Equation (1)}$$

Figure 10B:
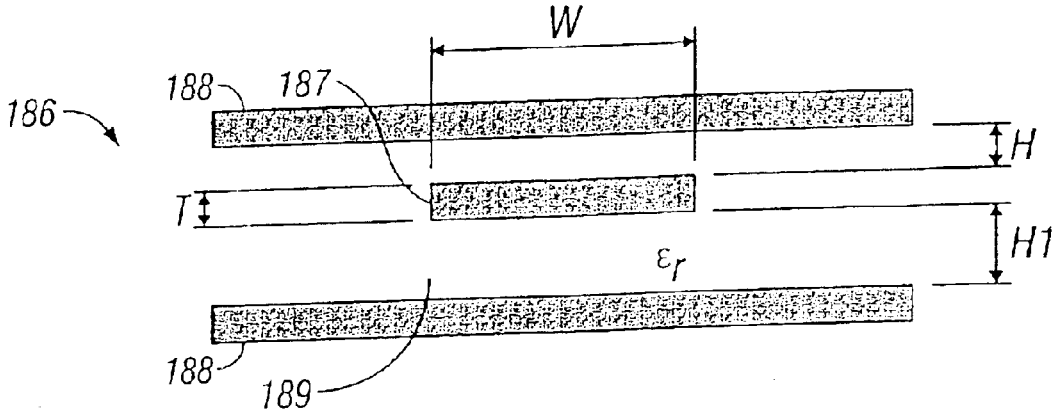
FIG. 10*b* illustrates a strip line geometry for a connector formed in accordance with at least one embodiment of the present invention.

FIG. 10*b* illustrates a graphical representation of a cross-section of a strip line geometry 186 that is formed by the coaxial cable connector 10. In the strip line geometry 186, a center conductor 187 is sandwiched between two wider ground conductors 188. The center and ground conductors 187 and 188 are planar in shape and aligned in planes extending parallel to one another. The center conductor 187 is formed with a width (W) and a thickness (T). The ground conductors 188 are spaced from the center conductor 187 by spacings H and H1. The center conductor 187 is surrounded by a dielectric material 189 filling the void between the ground conductors 188. The dielectric material 189 has a relative dielectric constant of $\epsilon_r$. The general formula defining the impedance produced by the strip line geometry 186 is represented by the following equation:

$$Z_0 = \frac{80}{\sqrt{\varepsilon_r}} \ln\left(\frac{1.9(2H+T)}{0.8W+T}\right)\left(1 - \frac{H}{4 \times HI}\right) \text{ Ohms} \qquad \text{Equation (2)}$$

The strip line geometry 186 is more easily manufactured and the design parameters are more readily controlled during production as compared to connectors maintaining circular geometries or other geometries that produce symmetric electric field distribution. By way of example, during the manufacture of the coaxial cable connector 10 having the strip line geometry 186, the manufacturing process more easily controls the spacings H and H1, thickness (T), width (W) and relative dielectric $\epsilon_r$. The structures forming the strip line geometry 186 enables the impedance of the coaxial cable connector 10 to be easily controlled. This ability translates to reduced manufacturing costs.

Figure 11:
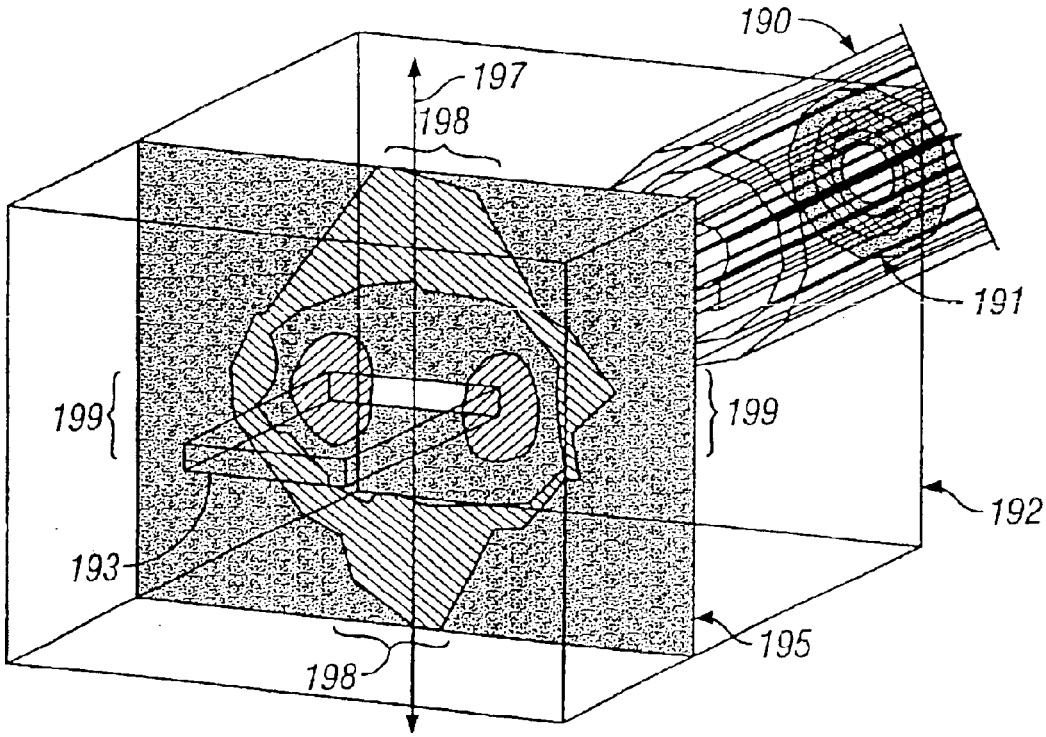
FIG. 11 illustrates electric field distributions surrounding a coaxial cable and a connector attached thereto in accordance with at least one embodiment of the present invention.

FIG. 11 illustrates electric field distributions formed about a coaxial cable and about a coaxial cable connector 10 connected to the coaxial cable. A series of parallel lines 190 denote the geometry of the coaxial cable. A large rectangular box 192 denotes a general geometry for the coaxial cable connector 10. A smaller shadow box 193 denotes the general geometry of a contact blade, such as contact blades 16 and 216. The shadow box 193 may also represent a receptacle contact, such as formed by receptacle contact 18 or 218.

An electric field distribution 191 is produced by the coaxial cable. The electric field distribution 191 is distributed symmetrically about a circumference of the coaxial cable and decreases in intensity at greater radial distances from the center conductor of the coaxial cable. A representative magnitude distribution for the electric field distribution 191 is illustrated as a series of concentric shaded rings that are aligned in one plane traversing the coaxial cable (e.g., perpendicular to the cable axis). A feature of electric fields formed about a coaxial cable geometry is that the magnitude/intensity distribution of the electric fields are circumferentially uniform and vary only in the radial direction.

An electric field 195 is formed by the coaxial cable connector 10. The electric field 195 is distributed asymmetrically about the coaxial cable connector 10 and is oriented with a particular relation to the strip line geometry 186 created between the blade contacts 16 and 216 and the corresponding side walls 130, 237 and 239 (as discussed above with FIG. 10*b*). The distribution of the magnitude or intensity for the electric field 195 is denoted by asymmetric shaded areas surrounding the shadow box 193. The electric field 195 is oriented proximate opposite sides of the shadow box 193 along a transverse axis 197 extending perpendicularly to the plane of the shadow box 193. As shown by the shaded areas in the electric field 195, the magnitude or flux density is primarily concentrated in major areas 198 centered about the transverse axis 197 and extending in opposite directions. The magnitude or flux density of the electric field 195 is secondarily concentrated to a much lesser extent in lateral areas 199 near side edges of the shadow box 193 (representing the side edges of the blade contacts 16 and 216). Stated another way, the magnitude or flux density of the electric field 195 is focused primarily in major areas 198, while being focused in lateral areas 199 to a lesser degree.

In the embodiment of FIG. 1, the blade contact 16 represents the center conductor 187. The thickness and width of the blade contact 16 is easily controlled when stamping the blade contact 16 from a flat planar metal sheet of known thickness. The side walls 130 of the contact shells 20 and 22 represent ground conductors 188. The width of the top walls 36 define the spacings H and H1 between blade contact 16 and side walls 130. The distances between the blade contact 16 and the connecting walls 132 in each contact shell 20 and 22 may be formed sufficiently wide such that the connecting walls 132 have a minimal impact on the impedance of the coaxial cable connector 10.

In accordance with at least one embodiment, the contact shells 20 and 22 afford a one-piece contact system that utilizes the insulated housings 12 and 14 as "stuffers" to retain the coaxial cables (e.g., cable 160) intact during a crimping process. The insulated housings 12 and 14 also assist in locating the coaxial cables 160. The width of the braid-receiving slot is dependent upon the diameter of the conductive braid. By way of example only, the braid-receiving slot width may be slightly larger (e.g., a few thousandths of an inch) than the diameter of the conductive braid with multiple conductors of the braid in each braid-receiving slot. This permits a significant amount of plastic deformation during the assembly process. Deformation of the conductive braid along with the wiping action that occurs during assembly ensures that clean metallic surfaces on the multiple conductors of the conductive braid come into contact with the coaxial cable displacement contacts 138 while retaining a desired amount of residual spring force between the multiple conductors and the coaxial cable displacement contacts 138. Retaining a desired residual spring force between the braid conductors and the coaxial cable displacement contacts 138 provides a stable long term, low resistance contact interface.

Optionally, the shape of the displacement beams and displacement beam tips may be varied. The displacement beam tip may be provided with a double edge used to ensure that when the displacement beam is inserted into the dielectric material of the coaxial cable, the displacement beams travel along a straight line. Tapering the displacement beam provides added strength, while reducing unwanted deflection of the displacement beam during installation.

During assembly of the coaxial cable connector and two cables, the following steps may be carried out. Initially, the ends of the two coaxial cables to be interconnected are stripped to expose an end portion of their respective center conductors. The exposed end portion of the center conductors are then inserted into the openings 104 and 114 in the blade contact 16 and receptacle contact 18, respectively. The wire crimps 102 and 112 are compressed to securely retain the exposed end portions of the center conductors. Next, the coaxial cables and the blade and receptacle contacts 16 and 18 are inserted into respective insulated housings 12 and 14. With reference to FIG. 1, the body section 90 of the blade contact 16 is inserted (laterally or longitudinally) into the slot 48, and the wire crimp 102 is inserted into the chamber 50. An unstripped portion of the coaxial cable behind the exposed center conductor is inserted into the cavity 52 until leading edges of the dielectric material, cable braid and cable jacket abut against shelves 51 near the rear ends 53 of the side walls 44. Once inserted, a leading tip portion of the body section 90 of the blade contact 16 projects forward from the notched portion 23 of the mating face 24. The blade contact 16 and receptacle contact 18 are joined when the insulated housing 12 and 14 are combined.

Each of the contact shells 20 and 22 are separately mounted on a corresponding one of the insulated housings 12 and 14. During mounting, the contact shells 20 and 22 are separately inserted along an axis 11 (FIG. 1) aligned perpendicularly to the longitudinal axis 13 of the coaxial cable connector 10. As the contact shells 20 and 22 are inserted, the coaxial cable displacement contacts 138 pierce the corresponding coaxial cables 160 and the displacement beams 154 engage the outer cable braids 164 (as illustrated in FIG. 9). Next, an outer housing is assembled to the coaxial cable connector 10.

Once assembled, the insulated housings 12 and 14, blade and receptacle contacts 16 and 18, and contact shells 20 and 22 cooperate (as illustrated in FIG. 2) to define a strip line contact configuration as discussed above in connection with FIG. 10*b* to afford a desired impedance for signals carried through the coaxial cable connector 10. The process of assembling the coaxial cable connector 10 is easily automated, reliable and cost effective.

Figure 12:
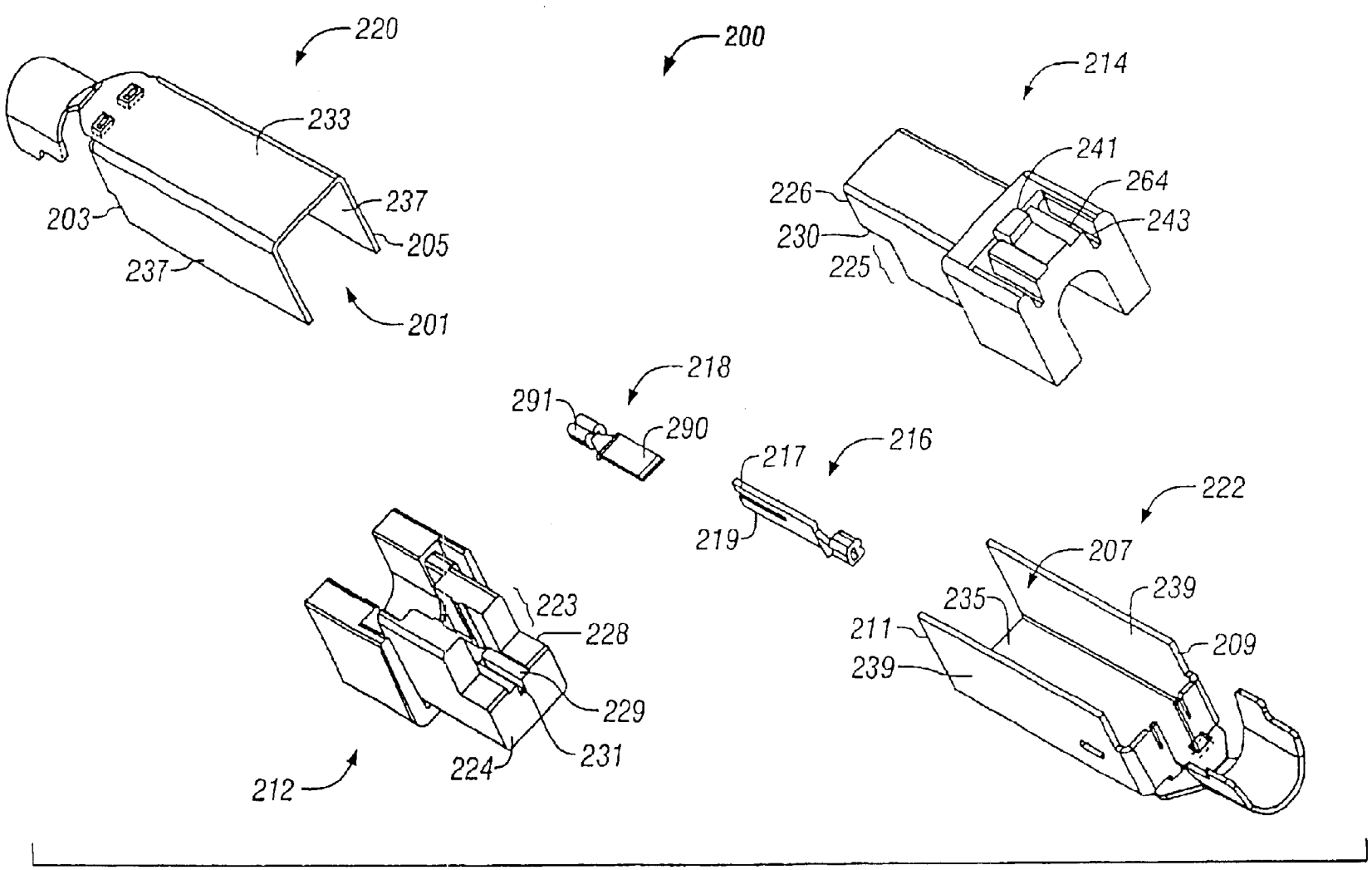
FIG. 12 illustrates an exploded isometric view of a connector formed in accordance with an alternative embodiment of the present invention.

FIG. 12 illustrates a coaxial cable connector 200 formed in accordance with an alternative embodiment. The coaxial cable connector 200 includes insulated housing 212 and 214, a blade contact 216, a receptacle contact 218, and contact shells 220 and 222. The contact shells 220 and 222 include side walls 237 and 239, respectively, and connecting walls 233 and 235, respectively. The blade contact 216 functionally replaces blade contact 16, while the receptacle contact 218 functionally replaces receptacle contact 18. The first and second insulated housings 212 and 214 include mating faces 224 and 226, respectively, that have even more pronounced notched portions 223 and 225 and shelves 228 and 230, respectively. The shelf 228 includes a notch 229 that accepts a body section 290 of the receptacle contact 218. The shelf 228 also includes a slot 231 that accepts a finger 219 of the blade contact 216.

The side walls 237 and 239, and corresponding connecting walls 233 and 235, are formed in U-shapes and have open faces 201 and 207, respectively. The side walls 237 and 239 include contact retention ends 203 and 209, and open ends 205 and 211, respectively, opposite one another. The open faces 201 and 207 extend from the contact retention ends 203 and 209 to the open ends 205 and 211, respectively, to afford the advantages discussed above in connection with contact shells 20 and 22.

Figure 13:
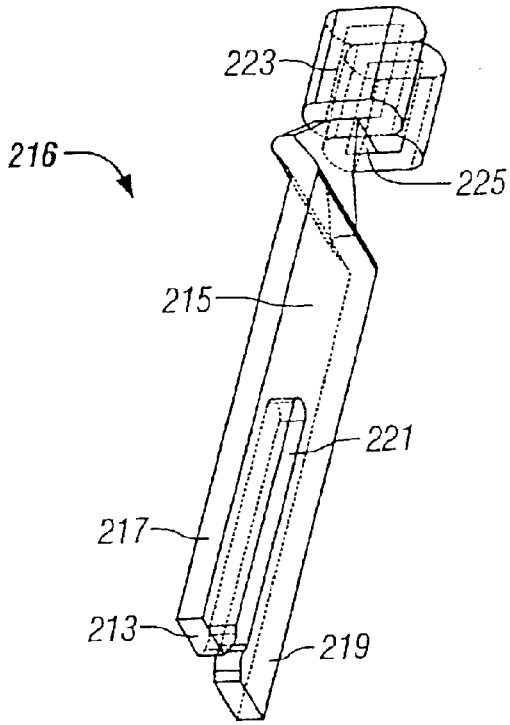
FIG. 13 illustrates a receptacle contact formed in accordance with an alternative embodiment of the present invention.

The blade contact 216 is illustrated in more detail in FIG. 13. The blade contact 216 includes a body section 215 with fingers 217 and 219 extending therefrom. The fingers 217 and 219 are separated by a slot 221 extending partially along a length of the body section 215 rearward from a leading edge 213. A rear end of the body section 215 is secured to a wire crimp 223 having an opening 225 therethrough to receive the center conductor of a coaxial cable connected thereto.

The blade contact 216 and receptacle contact 218, when joined, are aligned in perpendicular planes. The plane containing the fingers 217, 219 of the blade contact 216 is aligned parallel to the side walls 237 and 239 of the contact shells 220 and 222, respectively. The plane containing the body section of the receptacle contact 218 is aligned parallel to the connecting walls 233 and 235 of the contact shells 220 and 222, respectively. As shown in FIGS. 12 and 13, the body section 290 of the contact 218 is formed with a width that is greater than a width of an adjoining crimp 291.

Optionally, the body section 290 may be different than shown in FIG. 12. The body section 290 may be dimensioned to cooperate with the connecting walls 233 and 235 to produce a second strip line geometry. The second strip line geometry is perpendicular to the strip line geometry formed by the blade contact 216 and the side walls 237 and 239 to form a dual strip line geometry. In this dual strip line geometry, the blade and receptacle contacts 216 and 218 form a cross arrangement. Optionally, one or more of the blade contacts 16, 216 and receptacle contacts 18, 218 may include multiple contacts that are similarly shaped and oriented parallel or perpendicular to one another. By way of example, two contacts may be stacked parallel to one another or two contacts may be oriented perpendicular to one another.

The connecting walls 132, 233 and 235 and side walls 130, 237 and 239, individually and collectively, constitute ground contacts. In other words, each connecting wall 132, 233 and 235 constitutes an individual ground contact. The combination of opposed connecting walls 132, 233 and 235 may be considered to constitute a ground contact. The combination of opposed side walls 130, 237 and 237 may be considered to constitute a ground contact. As a further example, each connecting wall 132, 233 and 235 in combination with one or more adjoining side walls 130, 237 and 239 may be considered a ground contact.

The insulated housing 214 includes a latch 241 projecting upward from the top wall 264. The latch 241 enables the coaxial cable connector 200 to be mounted to another structure. Channels 243 are also provided in the top wall 264 on either side of the latch 241 to provide an even wall thickness to improve moldability and to reduce the amount of material used.

Figure 14:
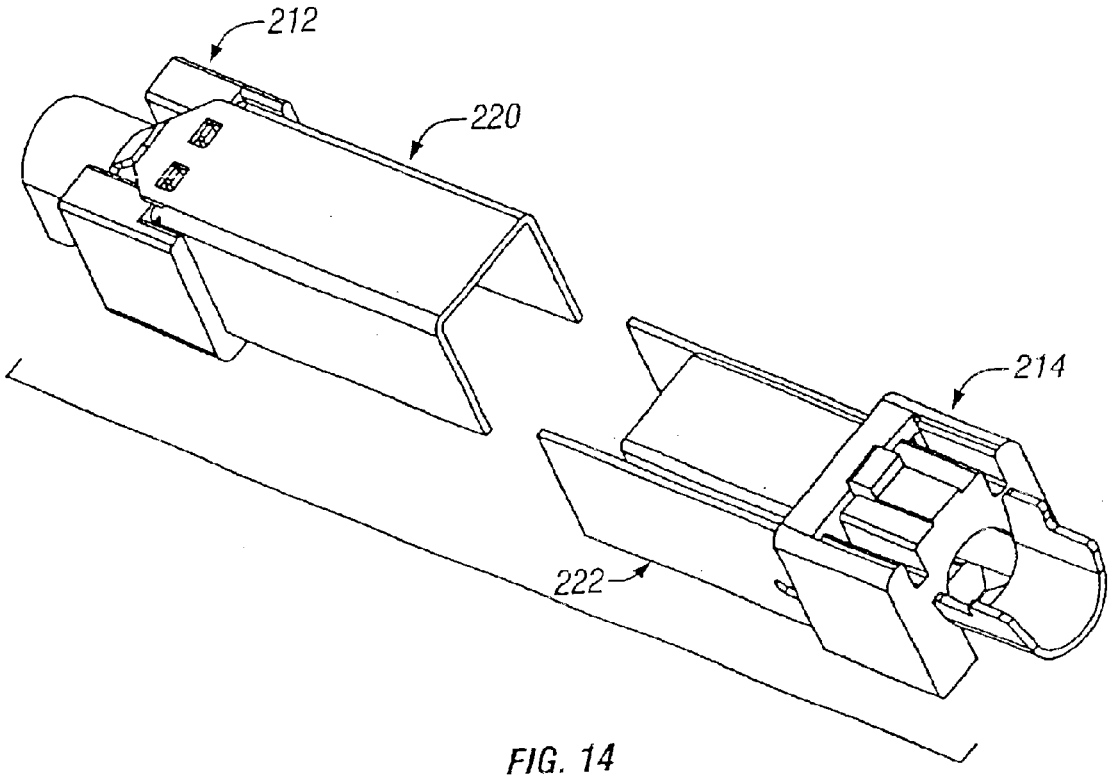
FIG. 14 illustrates a connector partially assembled in accordance with an alternative embodiment of the present invention.

FIG. 14 illustrates the contact shells 220 and 222 assembled with corresponding housings 212 and 214. As illustrated in FIG. 14, during assembly, the contact shells 220 and 222 may be connected with corresponding coaxial cables and insulated housings 212 and 214 before the insulated housings 212 and 214 are mated with one another.

Figure 15:
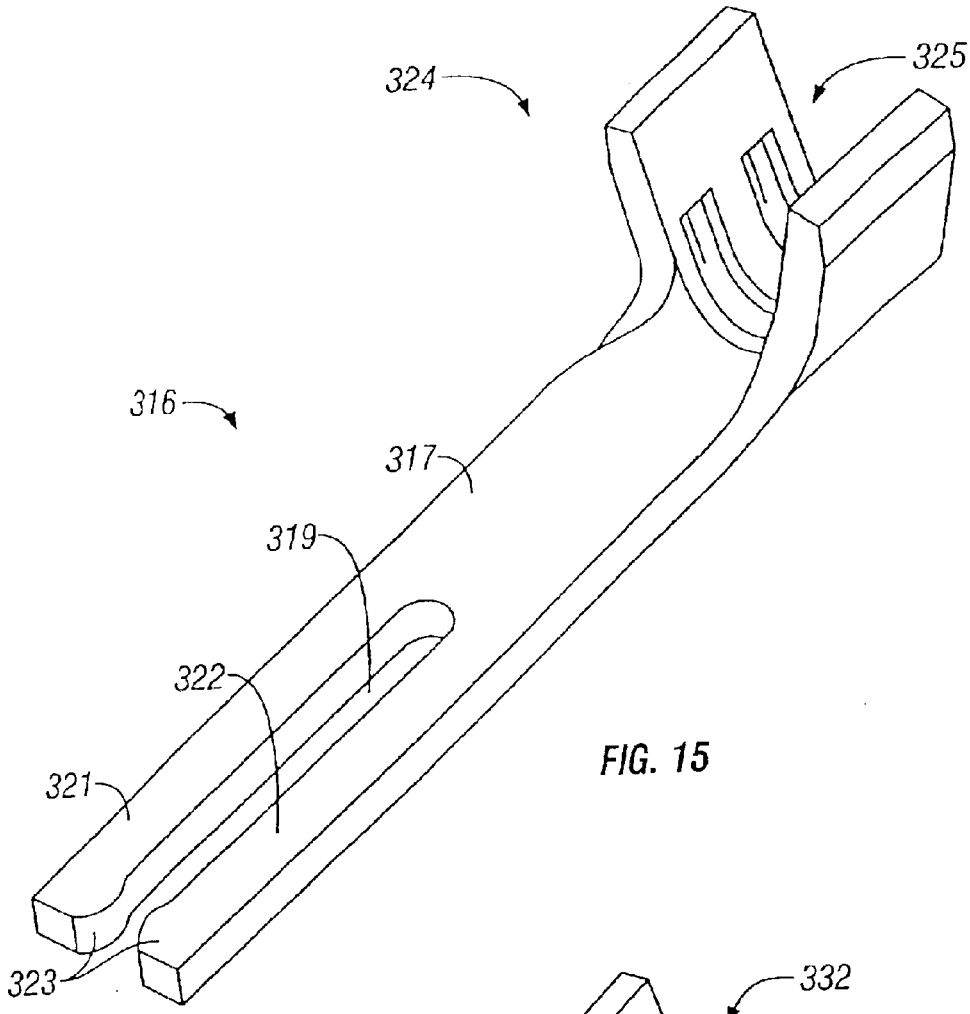
FIG. 15 illustrates a center contact formed in accordance with at least one embodiment of the present invention.
Figure 16:
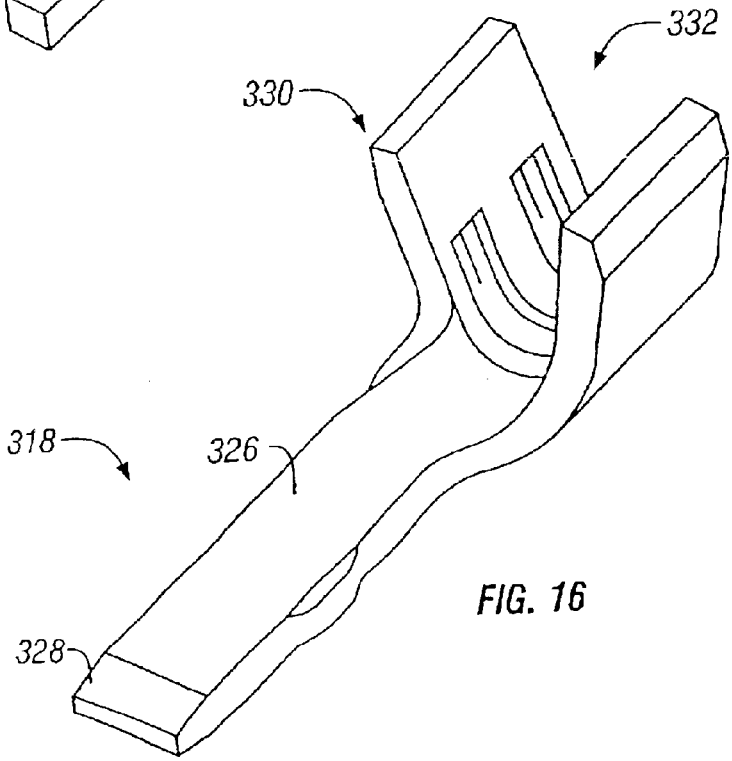
FIG. 16 illustrates at least one center contact formed in accordance with an embodiment of the present invention.

FIGS. 15 and 16 illustrate blade and receptacle contacts 316 and 318, respectively. In FIG. 15, the blade contact 316 is illustrated having a planar body section 317 with a slot 319 cut in an outer end thereof to form a fork having fingers 321 and 322. At the outer ends of the fingers 321 and 322, rounded projections 323 are provided in the opening to the slot 319 and are oriented to face one another. The projections 323 ensure a secure frictional and electrical interconnection between the blade contact 316 and a joining receptacle contact 318 when the receptacle contact 318 is inserted into the slot 319. An opposite end of the body section 317 includes a crimp 324 having an opening 325 that receives a center conductor of a coaxial cable. The crimp 324 is securely clasped to the center conductor of the coaxial cable.

FIG. 16 illustrates a receptacle contact 318 having a planar body section 326 with a beveled outer end 328 for insertion between the projections 323 on the blade contact 316. An opposite end of the body section 326 includes a crimp 330 having an opening 332 that receives a center conductor of the corresponding coaxial cable. The crimp 330 is formed to securely attach to the center conductor of the coaxial cable.

Figure 18:
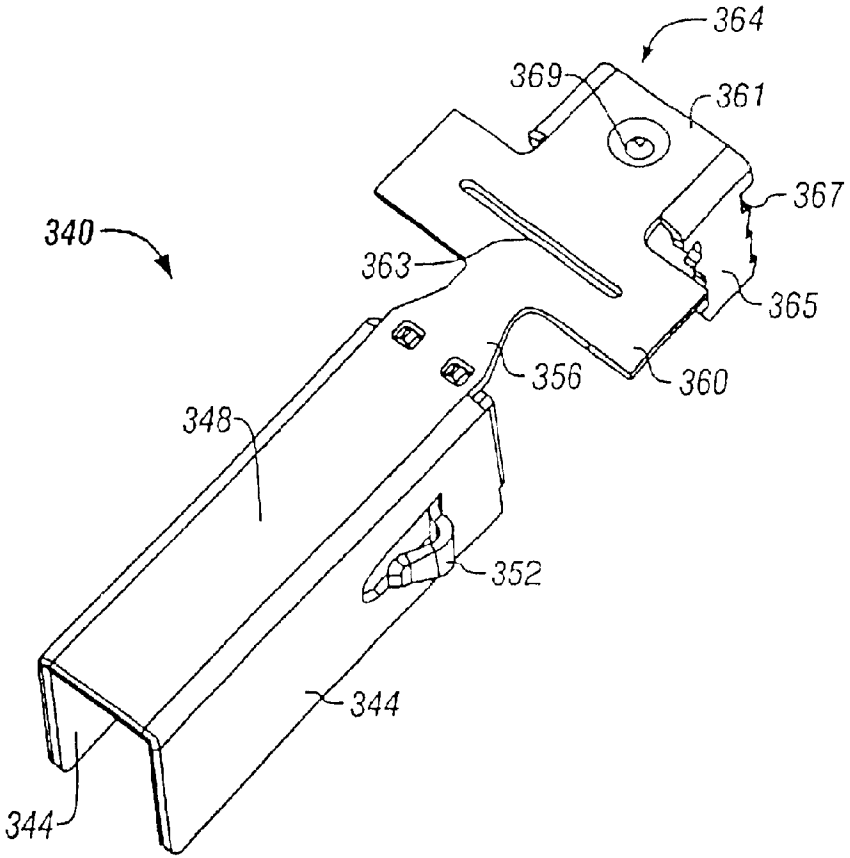
FIG. 18 illustrates an isometric view of a shell formed in accordance with at least one embodiment of the present invention.
Figure 17:
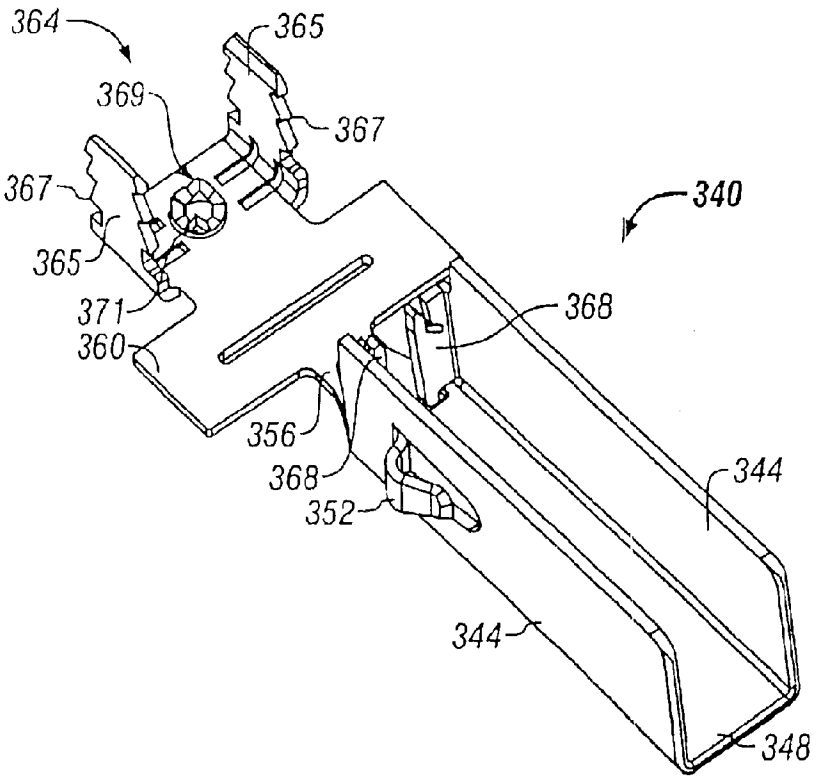
FIG. 17 illustrates an isometric view of a shell formed in accordance with at least one embodiment of the present invention.

FIGS. 17 and 18 illustrate opposite views of an alternative configuration for a contact shell. Each contact shell 340 includes side walls 344 and a connecting wall 348. A projection 352 is provided on at least one side wall 344 to ensure a proper electrical connection between mating contact shells 340.

The connecting walls 348 includes a transition region 356 at a rear end thereof that is formed integrally with a laterally extending separation plate 360. The separation plate 360 includes a slot 363 to facilitate cutting of the separation plate 360 during assembly. The separation plate 360 is in turn formed integrally with a strain relief crimp 364. During assembly, the strain relief crimp 364 is physically separated from the transition region 356, such as through a stamping operation, and then secured to the coaxial cable.

The strain relief crimp 364 is U-shaped and includes a laterally extending body portion 361 joining the separation plate 360. The body portion 361 is secured at opposite ends to arms 365 that extend parallel to one another and in a direction perpendicular to the body portion 361. The arms 365 include ribs 367 along both side edges thereof. The body portion 361 includes a cable grip 369 centered between the arms 365. The cable grip 369 includes teeth 371 directed inward to face the coaxial cable. The teeth 371 pierce the jacket of the coaxial cable and engage the outer conductor when the strain relief crimp 364 is secured to the coaxial cable. The cable grip 369 may be formed in a punched star pattern with a plurality of teeth 371 being stamped, and bent to face inward. Alternatively, the teeth 371 may be replaced with a single tooth or, with one or more barbs. Optionally, the cable grip 369 need not engage the outer conductor, but instead may only pierce a surface of the jacket sufficiently to resist any anticipated cable stresses.

Figure 19:
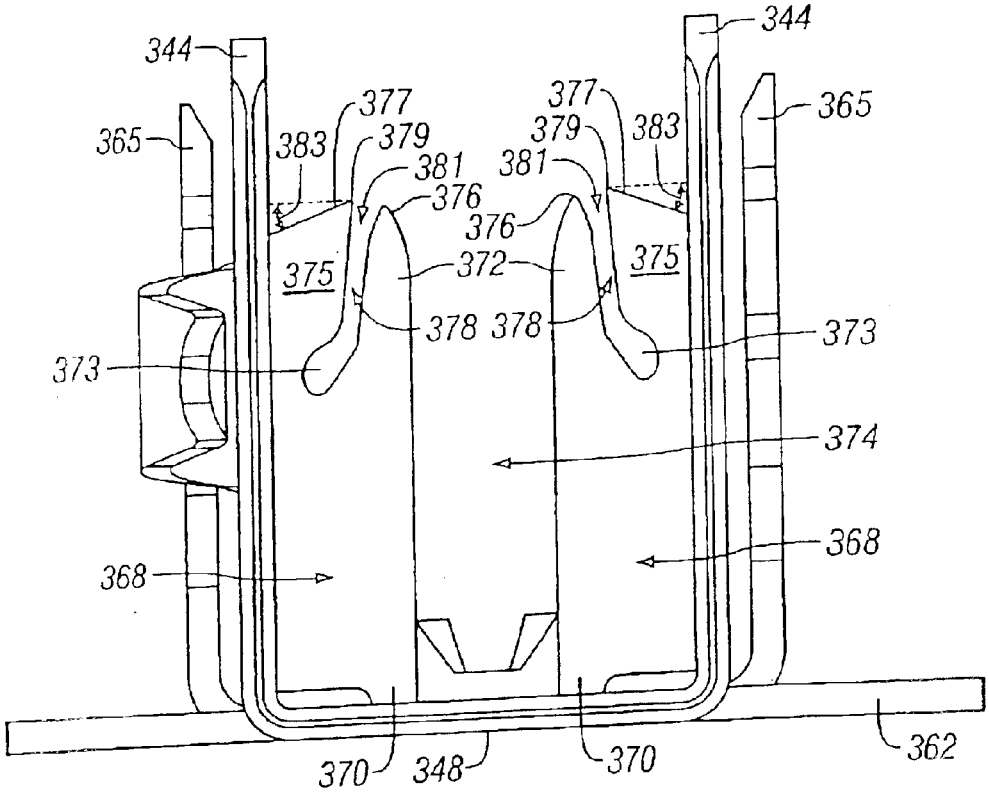
FIG. 19 illustrates an end view of a shell formed in accordance with at least one embodiment of the present invention.

FIG. 19 illustrates an end view of contact shell 340. The coaxial cable displacement contacts 368 include support projections 370 formed on lower ends thereof to be loosely received in openings in the connecting wall 348. The displacement beams 372 extend upward and are separated from one another by a gap 374. The displacement beams 372 include pointed tips 376 that facilitate penetration of the jacket and outer conductor of the corresponding coaxial cable. Braid receiving slots 378 extend downward and are flared outward away from the gap 374 at base wells 373 to form a hooked shape.

The contact walls 375 include tapered undercut edges 377 extending along the top of the coaxial cable displacement contacts 368. The undercut edges 377 end at lead tips 379 which face one another and are located at mouths 381 of the braid receiving slots 378. The contact walls 375 shear the cable jacket away from the outer conductor as the coaxial cable displacement contacts 368 engage and pierce the coaxial cable. The undercut edges 377 form an acute angle with the central longitudinal axis of the displacement beams 372. The undercut edges 377 are tapered downward and away from the lead tips 379 at an acute angle 383 to horizontal (denoted by a dashed line) to form a collection area for the excess cable jacket material displaced as the outer conductor is wedged into the braid receiving slots 378, as well as to facilitate shearing. By shearing the cable jacket away from the outer conductor before entering the mouth 381, the coaxial cable displacement contacts 368 prevent the cable jacket from becoming wedged in the braid receiving slots 378. If the cable jacket becomes wedged in the braid receiving slots 378, it may interfere with the electrical connection between the outer conductor and the braid receiving slots 378.

Figure 20:
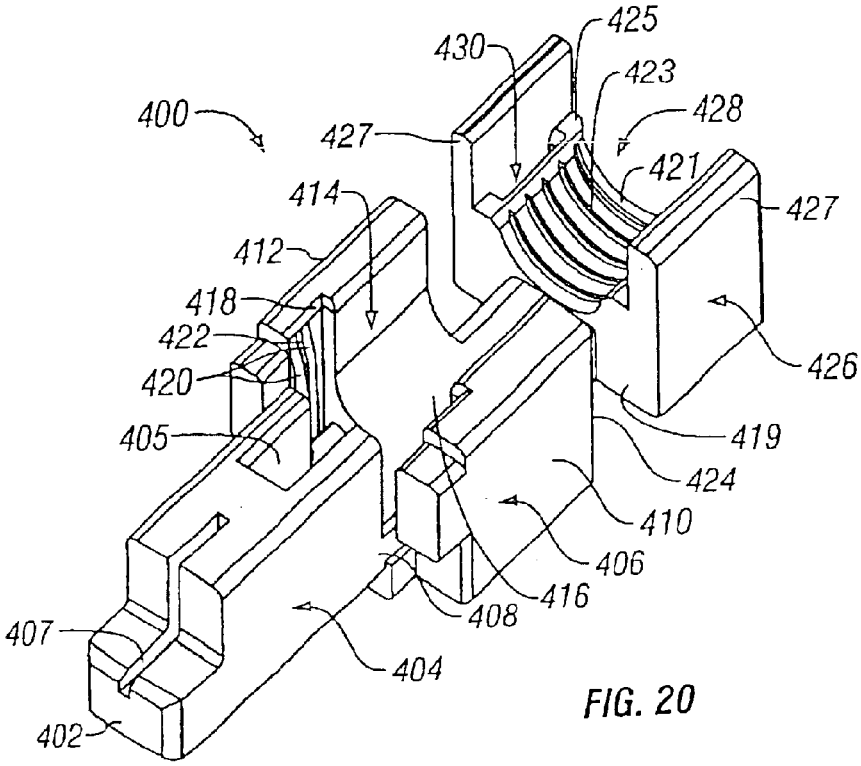
FIG. 20 illustrates an isometric view of an insulated housing formed in accordance with at least one embodiment of the present invention.
Figure 21:
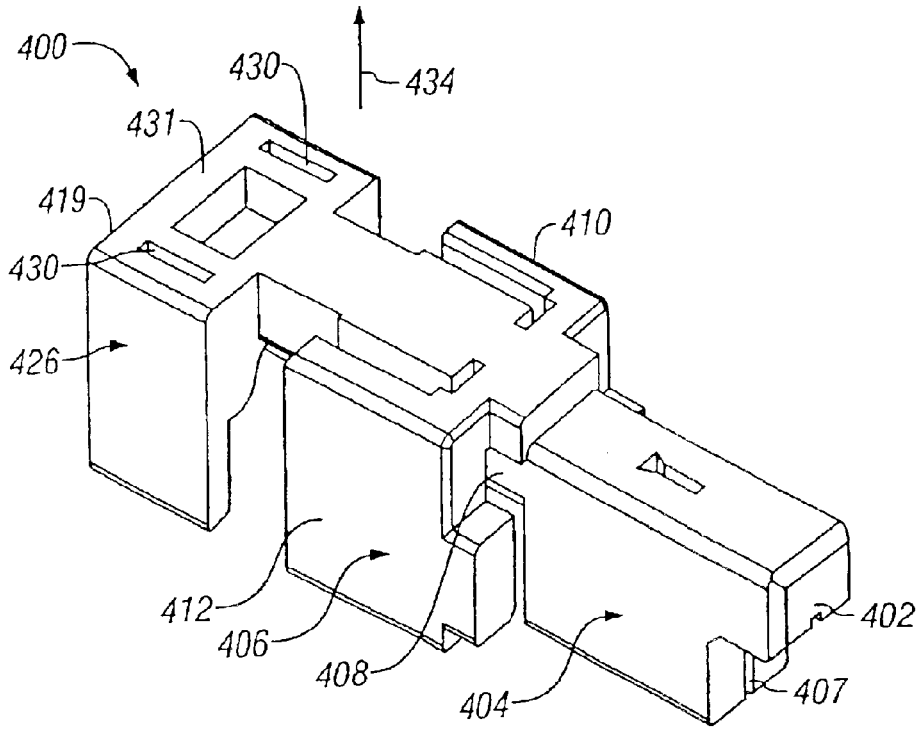
FIG. 21 illustrates an isometric view of an insulated housing formed in accordance with at least one embodiment of the present invention.

FIGS. 20 and 21 illustrate opposite views of an alternative embodiment for an insulated housing that may be used in one or both halves of a connector. The insulated housing 400 includes a mating face 402 on a front end of a rectangular body section 404. A rear end of the body section 404 is formed with a shroud 406 through a joining section 408. The shroud 406 includes opposed side walls 410 and 412 cooperating to define a U-shaped chamber 414 therebetween that receives the coaxial cable. Interior surfaces of the side walls 410 and 412 include notches 416 and 418 facing one another and extending vertically in a direction transverse to a length of the insulated housing 400. At least one of the notches 416 and 418 includes a pair of parallel ribs 420 that extend along the length of the corresponding notch 416 or 418.

The body section 404 includes a chamber 405 adapted to receive a leading end of the coaxial cable and a crimp on a blade or receptacle contact 316 or 318 attached thereto. A front end of the body section 402 includes a slot 407 that accepts an associated one of the blade and receptacle contacts 316 and 318.

A rear end 424 of the shroud 406 is joined with a strain relief member 426 having a base 419 with a U-shaped notch 428 therein. The notch 428 in the strain relief member 426 includes an inner surface 421 having transverse arcuate grooves 423. Opposite ends of the notch 428 form ledges 425. Side walls 427 extend upward from the ledges 425 along opposite sides of the notch 428. Channels 430 are formed in each ledge 425 and extend through the strain relief member 426 to a rear side 431. The channels 430 are spaced apart to align with and receive the arms 365 when the contact shell 340 is laterally joined with insulated housing 400 in the direction of arrow 434 (FIG. 21). The length of each channel 430 is slightly less than an outer dimension of the ribs 367 such that, as the arms 365 are pressed into channels 430, the ribs 367 engage ledge 425 to hold the strain relief crimp 364 and strain relief member 426.

As the strain relief crimp 364 and strain relief member 426 are pressed together, the teeth 371 of the cable grip 369 pierce the jacket and engages the outer conductor of the coaxial cable. The cable grip 369 secures the strain relief crimp 364 to the coaxial cable and prevents relative axial motion therebetween.

The cable grip 369 resists axial movement between the coaxial cable and the insulated housing 400 without deforming the circular cross-section of the coaxial cable. The strain relief crimp 364 and member 426 minimize compression of the coaxial cable into a compressed geometry which may otherwise interfere with the impedance and signal performance. The channels 430 and arms 365 need not have a rectangular cross-section, but instead may be circular, square, arcuate, triangular and the like. Optionally, the number of channels 430 and arms 365 may be fewer or greater than two.

Figure 22:
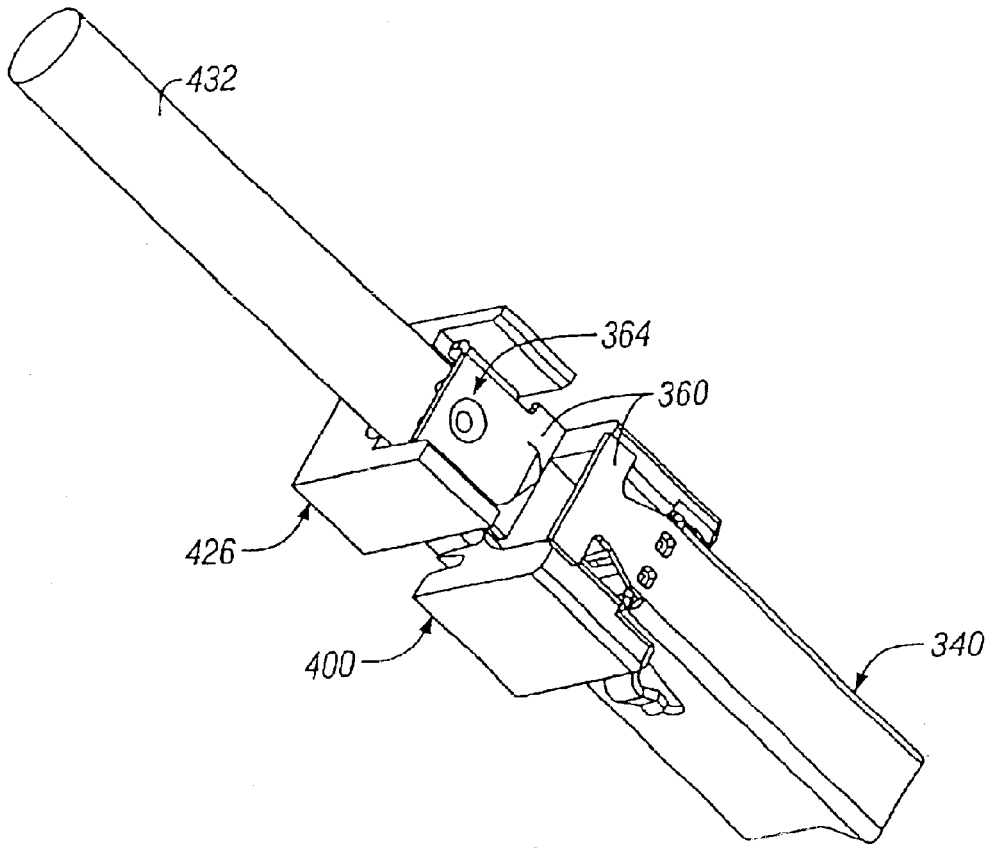
FIG. 22 illustrates a partially assembled connector in accordance with one embodiment of the present invention.

FIG. 22 illustrates the shell 340 mated to a corresponding insulated housing 400.

Figure 24:
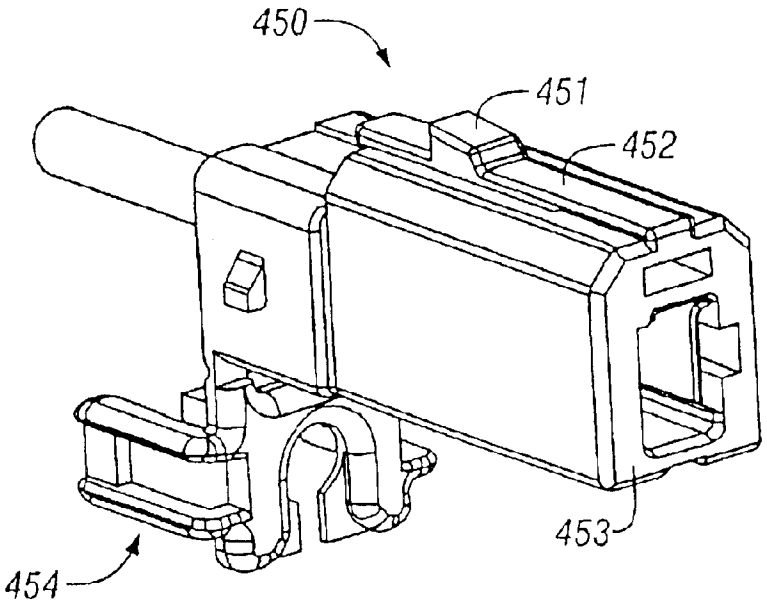
FIG. 24 illustrates an outer housing and coaxial cable joined in accordance with at least one embodiment of the present invention.
Figure 23:
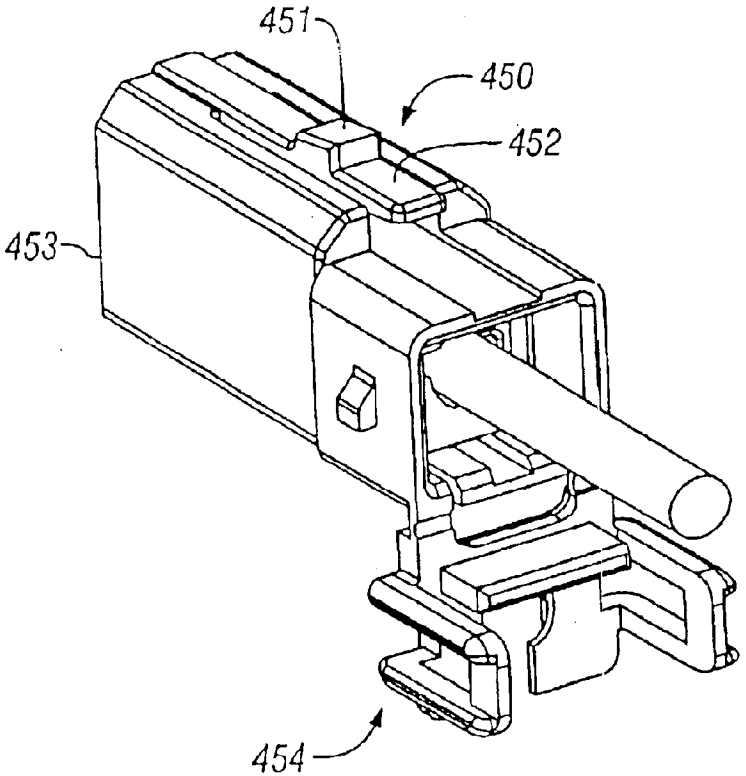
FIG. 23 illustrates an outer housing and coaxial cable joined in accordance with at least one embodiment of the present invention.

FIGS. 23 and 24 illustrate an outer housing 450 provided over one of the shells 340 once mounted to an insulated housing 400. The outer housing 450 is formed of an insulated material. The outer housing 450 includes a latch beam 452 on one exterior surface thereof. The latch beam 452 includes a latch projection 451. A secondary lock member 454 is provided on one end of the outer housing 450.

Figure 26:
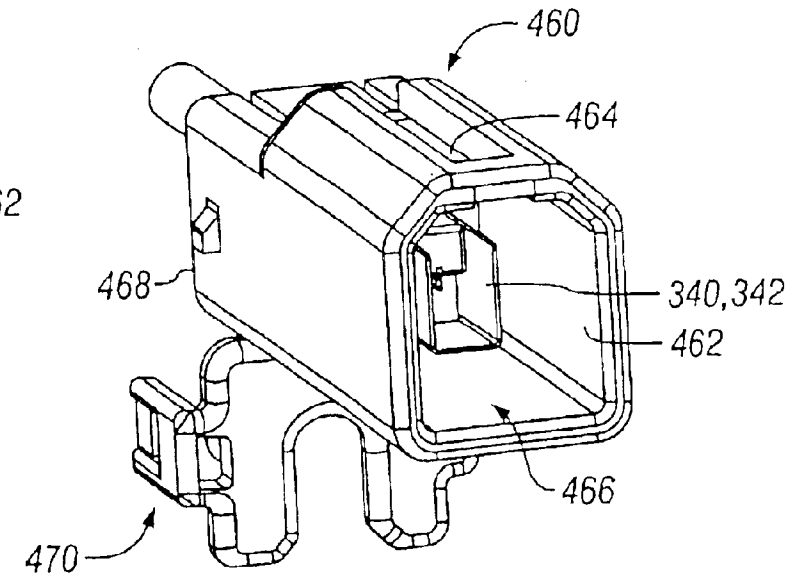
FIG. 26 illustrates an outer housing and coaxial cable joined in accordance with at least one embodiment of the present invention.
Figure 25:
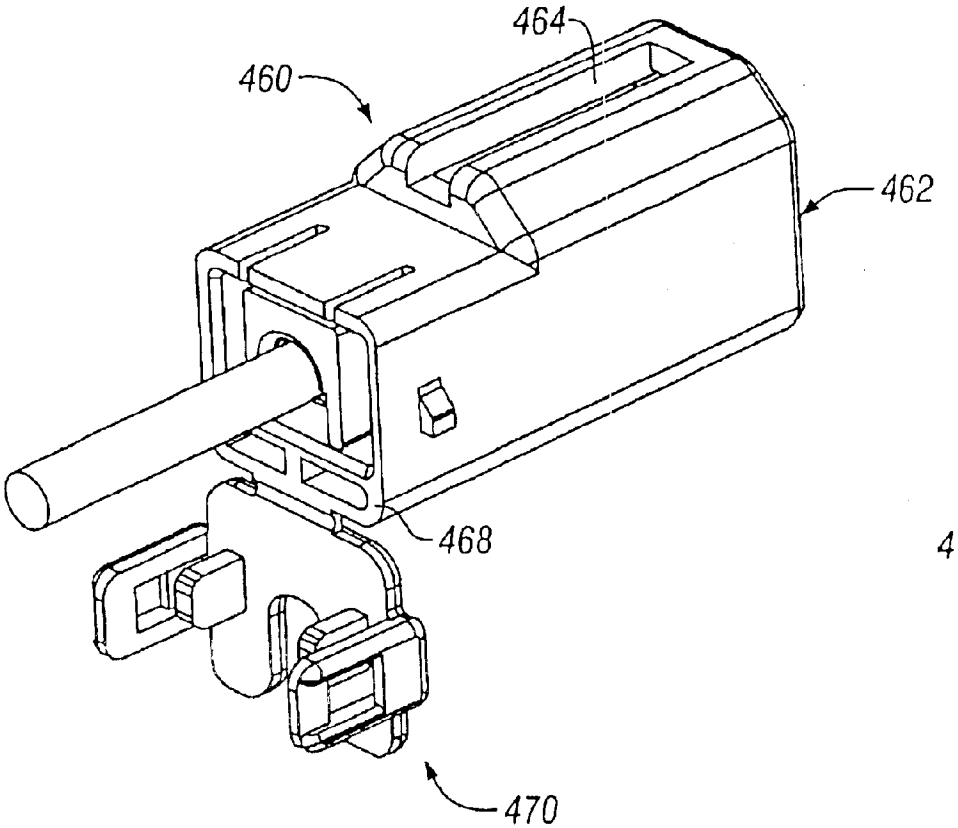
FIG. 25 illustrates an outer housing and coaxial cable joined in accordance with at least one embodiment of the present invention.

FIGS. 25 and 26 illustrate an outer housing 460 provided over another of the shells 340 once mounted to an insulated housing 400. The outer housing 460 is configured to mate with the outer housing 450. The outer housing 460 includes a mating end 462 adapted to receive the end 453 of the outer housing 450. A slot 464 is provided in one side of the outer housing 460 to accept the latch projection 451 on the latch beam 452 of the outer housing 450. FIG. 26 illustrates an interior chamber 466 within the outer housing 460, in which is viewable a shell 340 securely retained therein. An opposite end 468 of the outer housing 460 is formed with a secondary lock member 470.

Figure 27:
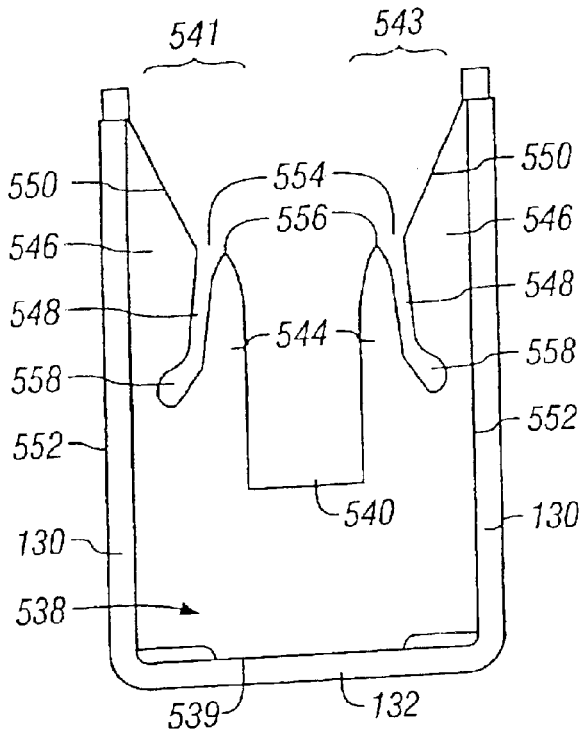
FIG. 27 illustrates a coaxial cable displacement contact formed in accordance with an alternative embodiment of the present invention.

FIG. 27 illustrates an alternative embodiment of a coaxial cable displacement contact. The coaxial cable displacement contact 538 may be formed on either one of the side walls or a connecting wall, such as one of side walls 130 or connecting wall 132 (FIG. 1). The coaxial cable displacement contact 538 is aligned in a plane perpendicular to the longitudinal axis of a corresponding contact shell, such as contact shell 20 (FIG. 1). In the example of FIG. 27, the coaxial cable displacement contact 538 is joined with the connecting wall, such as connecting wall 132, along edge 539.

The coaxial cable displacement contact 538 includes a gap 540 defining a channel between forked displacement sections 541 and 543. Each displacement section 541 and 543 includes a displacement beam 544 and a contact wall 546 separated by a slot 548. Upper ends of the contact walls 546 include lead-in edges 550 formed to slope inward and downward from outer edges 552 of the coaxial cable displacement contact 538. The lead-in edges 550 slope inward and downward to join mouths 554 of the slots 548 proximate tips 556 on upper ends of the displacement beams 544. The lead-in edges 550 direct the cable jacket onto the displacement beams 544. Lower ends of the slots 548 include wells 558 configured to receive an outer conductor of the coaxial cable when the displacement beams 544 pierce the outer jacket and the outer cable. The spacing between the displacement beams 544 and the slots 548 is determined based upon the dimensions of a coaxial cable to be secured therein.

Figure 29:
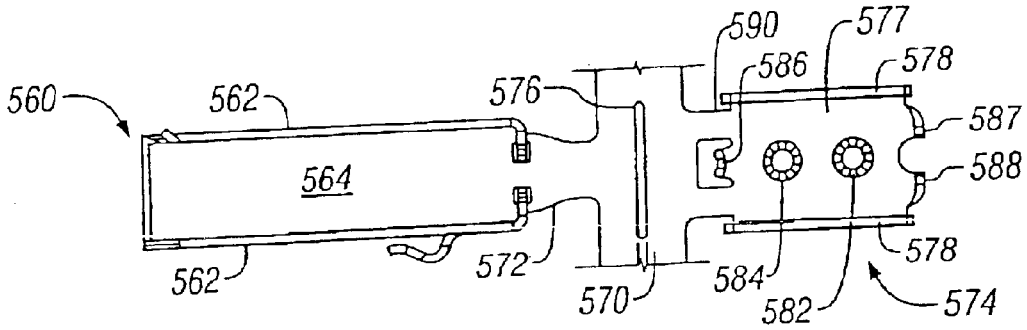
FIG. 29 illustrates a top plan view of a contact shell formed in accordance with an alternative embodiment of the present invention.
Figure 28:
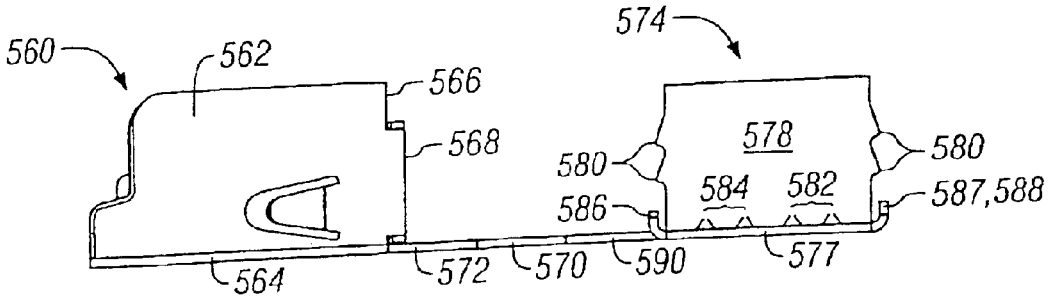
FIG. 28 illustrates a side view of a contact shell formed in accordance with an alternative embodiment of the present invention.

FIGS. 28 and 29 illustrate an alternative embodiment for a contact shell. The contact shell 560 includes side walls 562 and a connecting wall 564. A contact retention end 566 of the side walls 562 includes coaxial cable displacement contacts 568. The connecting wall 564 is joined with a separation plate 570 through a transition region 572. The separation plate 570 is in turn connected to a strain relief crimp 574 through a transition region 590. The separation plate 570 includes a slot 576 to facilitate cutting of the separation plate 570.

The strain relief crimp 574 is U-shaped and includes a body portion 577 having arms 578 on opposite sides thereof and extending upward therefrom. The arms 578 include ribs 580 on opposite sides thereof. The strain relief crimp 574 operates in the same manner as the strain relief crimps 364 (discussed above in connection with FIGS. 17 and 18) to frictionally engage channels in a mating strain relief member (such as channels 430 in strain relief member 426 in FIGS. 20 and 21).

The strain relief crimp 574 includes multiple cable gripping features, such as cable grips 582 and 584 and barbs 586–588. Cable grips 582 and 584 are provided along the length of the body portion 577 and are formed by punching a star pattern in the body portion 577 and bending the star pattern to provide a circular ring of teeth extending upward from the body portion 577. The barbs 586–588 are provided on opposite ends of the body portion 577. In the example of FIGS. 28 and 29, a single barb 586 is stamped in, and bent upward proximate, the lead edge of the body portion 577 within the transition region 590 connecting the strain relief crimp 574 to the separation plate 570. A pair of barbs 587 and 588 are provided proximate the rear edge of the body portion 577 next to one another. The cable grips 582 and 584, and barbs 586–588 pierce the coaxial cable when the strain relief crimp 574 is securely joined with a corresponding strain relief member. The cable grips 582 and 584, and barbs 586–588 may extend so far into the coaxial cable as to completely pierce the outer jacket and engage and/or also pierce the outer conductor to afford a secure connection between the strain relief crimp 574 and the coaxial cable.

Optionally, the coaxial cable connector 10 may only be connected to a coaxial cable at one end, while being connected at the opposite end to a structure other than a coaxial cable. For example, the coaxial cable connector may have one end adapted to be connected to discrete components, a printed circuit board, a circuit board, a flex circuit, a differential pair, a twisted pair of wires, two wires, a back plane, and the like. Accordingly, the end of the coaxial cable connector 10 connected to the non-coaxial structure need not include a shell or coaxial cable displacement crimp as discussed above.

Optionally, the contact shells 20, 22, 220 and 222 may be formed in configurations other than a U-shape. Instead, both contact shells in a pair (e.g., contact shells 20 and 22) may be L-shaped and configured such that, when joined the two L-shaped contact shells form a shielding box that surrounds and provides 360 degrees of shielding in a plane transverse to the axis of the cable axis. The 360 degrees of shielding substantially surrounds the inner contacts (including the crimps attaching the inner coaxial cable conductor to the inner contacts). When L-shaped, each contact shell includes two walls that may be different or equal length. Alternatively, the contact shells may have a modified J-shape, namely an L-shape with a flange bent on the outer end of the lower wall of the L-shape. The flange on the lower wall of each contact shell overlaps an adjoining upper a wall on the mating contact shell.

Optionally, both contact shells in a pair need not have the same cross-sectional shape, so long as the two contact shells, when mated, surround and provide 360 degrees of shielding in a plane transverse to the axis of the cable axis. The 360 degrees of shielding substantially surrounds the perimeter of the inner contacts and over the exposed inner conductors. Instead, one contact shell may provide shielding for three sides of the inner contacts/conductors, while the other contact shell may provide shielding for less than three sides. For example, one contact shell may be U-shaped while the other contact shell may be L-shaped, a modified J-shape or simply a flat wall covering the open face in the U-shaped contact shell mated thereto. The contact shells each may be formed with up to three walls.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications that incorporate those features which come within the spirit and scope of the invention.

What is claimed is:

1. A method for mounting a connector to a coaxial cable having inner and outer conductors separated by a dielectric layer, the method comprising:

exposing an end portion of an inner conductor of a coaxial cable;

securing an inner contact to the end portion of the inner conductor;

positioning the coaxial cable and inner contact in an insulated housing with the inner and outer conductors of the coaxial cable extending along a longitudinal axis of the insulated housing; and a coaxial cable displacement contact into the coaxial cable at a position that is laterally offset from the inner conductor until the coaxial cable displacement contact pierces the coaxial cable and receives the outer conductor in a receiving slot that is laterally offset from the inner conductor to thereby exert a retention force.

2. The method of claim 1, further comprising:

inserting a pair of coaxial cable displacement contacts into the coaxial cable, each of the coaxial cable displacement contacts laterally offset from the inner conductor of the coaxial cable until each of the pair of coaxial cable displacement contacts pierce and securely hold sections of the outer conductor that are laterally offset from the inner conductor of the coaxial cable.

3. The method of claim 1, further comprising:

before inserting coaxial cable displacement contact into coaxial cable, centering the coaxial cable over a gap between a pair of displacement beams on the coaxial cable displacement contact; and pressing the displacement beams onto the coaxial cable until the displacement beams pierce and electrically engage opposed side sections of the outer conductor with each displacement beam apply a retention force onto a respective opposed side section of the outer conductor of the coaxial cable.

4. The method of claim 1, further comprising:

inserting the coaxial cable displacement contact until piercing a dielectric layer of the coaxial cable with at least one displacement beam on the coaxial cable displacement contact.

* * * * *